US005446482A

United States Patent [19]

Van Aken et al.

[11] Patent Number: 5,446,482

[45] Date of Patent: Aug. 29, 1995

[54] FLEXIBLE GRAPHICS INTERFACE DEVICE SWITCH SELECTABLE BIG AND LITTLE ENDIAN MODES, SYSTEMS AND METHODS

[75] Inventors: Jerry R. Van Aken, Sugar Land; Chenwei J. Yin, Richardson, both of Tex.

[73] Assignee: Texas Instruments Incorporated, Dallas, Tex.

[21] Appl. No.: 792,503

[22] Filed: Nov. 13, 1991

[51] Int. Cl.[6] ..... G09G 1/28

[52] U.S. Cl. ..... 345/199; 345/150

[58] Field of Search ..... 345/199, 200, 189, 190, 345/186, 187, 185, 153, 154, 155, 150

[56] References Cited

U.S. PATENT DOCUMENTS

| | | | |
|---|---|---|---|
| 4,769,632 | 9/1988 | Work et al. | 340/701 |
| 4,808,989 | 2/1989 | Tabata et al. | 345/190 |
| 4,815,033 | 3/1989 | Harris | 364/900 |
| 5,107,415 | 4/1992 | Sato et al. | 395/800 |
| 5,313,231 | 5/1994 | Yin et al. | 345/199 |

FOREIGN PATENT DOCUMENTS 2229832 12/1990 United Kingdom ..... G06F 7/00

OTHER PUBLICATIONS

Brooktree "BT459", *Product Data Book 1989*, 1989, pp. 5-85-5-11.5.

Texas Instruments Incorporated, "TUS340 70-20 Color Palette" *Production Data*, 1986, pp. 1-15.

Brooktree, "Ramdac Products", *Winter 1990 Product Selection Guide*, Winter, 1990, pp. 9-15.

*Primary Examiner*—Ulysses Weldon
*Assistant Examiner*—Xiao M. Wu
*Attorney, Agent, or Firm*—Robert D. Marshall, Jr.; James C. Kesterson; Richard L. Donaldson

[57] ABSTRACT

A circuit 83, 97 is provided for selectively interpreting data received in a format selected from the big-endian and little-endian formats to an other one of the big-endian and little-endian formats and includes an array of j sequentially ordered data input terminals for receiving a j-bit word of data formatted in a preselected one of the big-endian and little-endian formats. An array of j sequentially ordered first AND gates 126 is provided, each first AND gate 126 having first and second input ports and an output port, the first input port of the $n^{th}$ first AND gate 126 coupled to the $n^{th}$ one of the input terminals, the second input ports of the first AND gates 126 coupled to a control signal. An array of j sequentially ordered second AND gates 128 are provided, and each second AND gate 128 having first and second input ports and an output port, of the first input port of an $n^{th}$ one of the second AND gates 128 coupled to a $(j-n+1)^{th}$ one of the first input terminals, the second input ports of the second AND gates 128 are coupled to a second control. An array of j sequentially ordered OR gates 130 are provided each having first and second input ports and an output port, the first input port of an $m^{th}$ one of the OR gates 130 being coupled to the output of an $m^{th}$ one of the first AND gate 126, the second input port of an $n^{th}$ one of the OR gates 130 coupled to the output of the $n^{th}$ one of the second AND gates 128. Wherein j is a consonant, n is a variable between 1 and j, and m is a variable between 1 and j.

25 Claims, 14 Drawing Sheets

FIG. 3
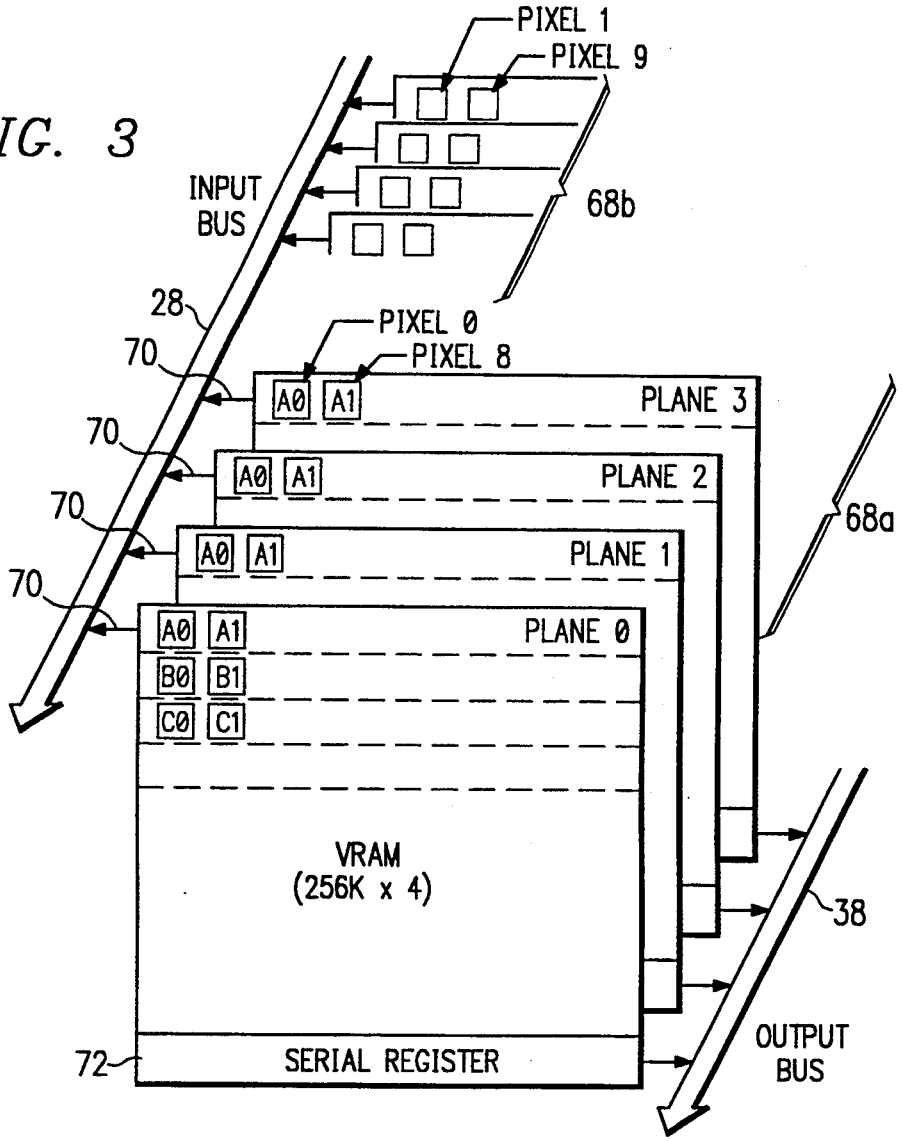
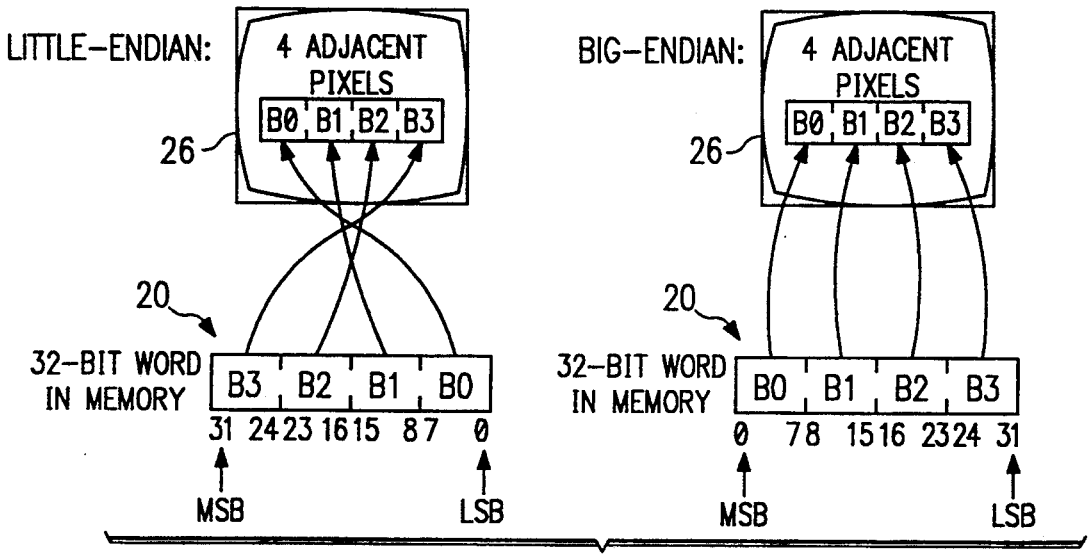
FIG. 7

FROM FIG. 6c
TO FIG. 6e
106q
108q
A
S1
B
S2
X
D
C
Q
110q
110r
112q
112r
114q
114r
116q
116r
P16
P17
P18
P19
P20
P21
P22
P23

FROM FIG. 6d
TO FIG. 6f
106y
108y
A
S1
B
S2
X
D
C
Q
110y
110z
112y
112z
114y
114z
P24
P25
P26
P27
P28
P29
P30
P31

FLEXIBLE GRAPHICS INTERFACE DEVICE SWITCH SELECTABLE BIG AND LITTLE ENDIAN MODES, SYSTEMS AND METHODS

CROSS-REFERENCE TO RELATED APPLICATIONS

U.S. Pat. No. 5,327,159, entitled "PACKED BUS SELECTION OF MULTIPLE PIXEL DEPTHS IN PALETTE DEVICES, SYSTEM AND METHODS"; U.S. patent application Ser. No. 07/734,344, entitled "TEST CIRCUITRY, SYSTEMS AND METHODS"; U.S. patent application Ser. No. 08/223,380, a continuation of U.S. patent application Ser. No. 07/720,100 now abandoned, entitled "SEQUENTIAL ACCESS MEMORIES, SYSTEMS AND METHODS"; U.S. Pat. No. 5,309,173, entitled "FRAME BUFFER, SYSTEMS AND METHODS"; U.S. Pat. No. 5,341,470, entitled "COMPUTER GRAPHICS SYSTEMS, PALETTE DEVICES AND METHODS FOR SHIFT CLOCK PULSE INSERTION DURING BLANKING"; U.S. Pat. No. 5,270,687, entitled "PALETTE DEVICES, COMPUTER GRAPHICS SYSTEMS AND METHODS WITH PARALLEL LOOK-UP AND INPUT SIGNAL SPLITTING"; U.S. patent application Ser. No. 08/080,735, a continuation of U.S. patent application Ser. No. 07/544,774, entitled "PALETTE DEVICES, SYSTEMS AND METHODS FOR TRUE COLOR MODE"; U.S. Pat. No. 5,309,551, entitled "DEVICES, SYSTEMS AND METHODS FOR PALETTE PASS THROUGH MODE"; U.S. patent application Ser. No. 08/116,476, a continuation of U.S. patent application Ser. No. 07/935,115 now abandoned, a continuation of U.S. patent application Ser. No. 07/544,771, entitled "INTEGRATED CIRCUIT INTERNAL TEST CIRCUITS AND METHODS"; U.S. Pat. No. 5,287,100, entitled "GRAPHICS SYSTEMS, PALETTES AND METHODS WITH COMBINED VIDEO AND SHIFT CLOCK CONTROL", all of the above are assigned to Texas Instruments Incorporated, the assignee of the present application, and are cross-referenced and incorporated into the present application by reference herein.

NOTICE

© Copyright, Texas Instruments Incorporated, 1990. A portion of the Disclosure of this patent document contains material which is subject to copyright protection. The copyright owner has no objection to facsimile reproduction by anyone of the patent document or the patent disclosure, as it appears in the U.S. Patent and Trademark Office, patent file or records, but otherwise reserves all rights in its copyright whatsoever.

TECHNICAL FIELD OF THE INVENTION

The present invention relates in general to graphics processors and in particular to a flexible graphics interface device with selectable big- and little-endian modes, systems and methods.

BACKGROUND OF THE INVENTION

Without limiting the general scope of the invention, its background is described in connection with computer graphics, as an example only.

In computer graphics systems, the low cost of dynamic random access memories (DRAM) has made it economical to provide a bit map or pixel map system memory. In such a bit map or pixel map memory, a color code is stored in a memory location corresponding to each pixel to be displayed. A video system is provided which recalls the color codes for each pixel and generates a raster scan video signal corresponding to the recalled color codes. Thus, the data stored in the memory determine the display by determining the color generated for each pixel (picture element) of the display.

The requirement for a natural looking display and the minimization of required memory are conflicting. In order to have a natural looking display, it is necessary to have a large number of available colors. This, in turn, necessitates a large number of bits for each pixel in order to specify the particular color desired from among a large number of possibilities. The provision of a large number of bits per pixel, however, requires a large amount of memory for storage. Since a number of bits must be provided for each pixel in the display, even a modest size display would therefore require a large memory. Thus, it is advantageous to provide some method to reduce the amount of memory needed to store the display while retaining the capability of choosing among a large number of colors.

The provision of a circuit called a color palette enables a compromise between these conflicting requirements. The color palette stores color data words which specify colors to be displayed in a form that is ready for digital-to-analog conversion directly from the color palette. Corresponding color codes having a limited number of bits are stored in the memory for each pixel have a limited number of bits, thereby reducing the memory requirements. The color codes are employed to select one of a number of color registers or palette locations. Thus, the color codes do not themselves define colors, but instead, identify preselected palette locations. These color registers or palette locations each store color data words which are longer than the color codes in the pixel map memory. The number of such color registers or palette locations provided in the color palette is equal to the number of selections provided by the color codes. For example, a 4-bit color code can be used to select $2^4$ or 16 palette locations. Significantly, the color data words can be redefined in the palette from frame to frame to provide many more colors in an ongoing sequence of frames than are present in any one frame. Significantly, the ability to redefine the color data words in the palette allow for the customization of colors on the display from one application to another.

Graphics processing systems may operate in either the big-endian or little-endian data formats. The big-endian and little-endian formats determine how data are interpreted as a function of the ordering of the words or bits making up a selected data structure. For example, the graphics processor may output a 32-bit word representing either one 32-bit, two 16-bit, four 8-bit, eight 4-bit, sixteen 2-bit or thirty-two 1-bit color code words (each color code word representing one pixel) to the color palette. Each color code word is normally assigned a designator, and for multiple bit color code words, each bit in a word is assigned a designator. Thus, if a 32-bit word from the frame buffer represents four 8-bit color code words to the palette, the 8-bit words may be designated B0–B3 and the corresponding 8 bits in each word designated D0–D7. In the little-endian format, the bit or word with the lowest designator represents the least significant bit or word in the data structure. In this example, bit DO would represent the least significant bit in each 8-bit word and word B0 would represent the least significant color code word in the 32-bit word output from the frame buffer. In the big-endian format, the bit or word with the lowest designator represents the most significant bit or word in the data structure. In this example, bit D0 would represent the most significant bit in each 8-bit word and word B0 would represent the most significant color code word in the 32-bit word received from the frame buffer.

Since the bit and word ordering of the big- and little-endian formats are essentially mirror images of each other, it is critical that both the graphics processor and the color palette operate in the same format when multiple bit words of pixel data are being output from the system frame buffer to the color palette. Specifically, the mapping of bits from memory to the display screen is performed in terms of the ordering of color code words received from the frame buffer. Further, in the normal operating mode the ordering of the bits in each color code word is critical to providing the proper address to the color palette look-up table. A color palette not operating in the same format as the processor will misinterpret the data from the frame buffer resulting in improper mapping to the display screen and/or improper addressing to the palette look-up table. It should be noted that these big/little-endian mode compatibility problems will normally not arise when pixel data is being transferred in only one pixel size (i.e. only in a preselected one of 1, 2, 4, 8, 16 or 32 bits for example). In this situation, the system and the associated palette can be appropriately wired to get to obtain compatibility, an approach which will not necessarily work when two or more pixel sizes are being supported by the same system.

In currently available color palettes that support more than one pixel size, only one format, big- or little-endian is typically selected for a particular palette design which limits the possible uses of that particular color palette to those compatible systems using the same format. Thus, two different color palette designs are now normally required to provide color palettes operable in systems using the two different formats. Simply put, the ability to insert a currently available color palette into any system, no matter which format, big- or little-endian, is lacking.

Due to the advantages of color palette devices, systems and methods, any improvement in their implementation is advantageous in computer graphics technology. Specifically, color palette devices, systems and methods operable in both those systems using the little-endian format and those systems using the big-endian would be particularly advantageous. Of particular advantage is the ability to build, test and sell a single color palette device operable in systems using either the big-endian or little-endian format in place of two separate color palettes, one for use in big-endian systems and one for use in little-endian systems.

SUMMARY OF THE INVENTION

According to the invention, a circuit is provided for selectively interpreting data received in a format selected from the big-endian and little-endian formats to an other one of the big-endian and little-endian formats. An array of j sequentially ordered data input terminals are provided for receiving a j-bit word of data formatted in a preselected one of the big-endian or little-endian formats. An array of j sequentially ordered first AND gates, are provided, each of the first AND gates having first and second input ports and an output port, the first input port of a $n^{th}$ one of the first AND gates coupled to an $n^{th}$ one of the input terminals. The second input ports of the first AND gates are coupled to a first control signal. An array of j sequentially ordered second AND gates are provided, each of the second AND gates having first and second input ports and an output port, the first input port of an $n^{th}$ one of the second AND gates coupled to a $(j-n+1)^{th}$ one of the input terminals. The second input ports of the second AND gates are coupled to a second control signal. An array of j sequentially ordered OR gates are further provided, each having first and second input ports and an output port, the first input port of a $m^{th}$ one of the OR gates coupled to the output of the $m^{th}$ one of the first AND gates, the second input port of a $n^{th}$ one of the OR gates coupled to the output of the $n^{th}$ one of the second AND gates.

According to other aspects of the invention, a current is provided with which a palette device can selectively interpret pixel data received according to whether the data is represented in big- or little-endian format.

The illustrated embodiments of the present invention provide the significant technical advantage of providing for the compatibility between graphics processing circuitry operating in the big-endian format and graphics processing circuitry operating in the little-endian data format. It is particularly advantageous to provide a single design, for color palette devices such that a selected color palette device may be operable in both those systems using the little-endian format and those systems using the big-endian format.

BRIEF DESCRIPTION OF THE DRAWINGS

For a more complete understanding of the illustrated embodiments of the present invention, and the advantages thereof, reference is now made to the following descriptions, taken in conjunction with the accompanying drawings, in which:

FIG. 3 is a schematic diagram depicting a preferred architecture for video RAM depicted in FIG. 1;

FIG. 7 is a simplified drawing of a portion of the display shown in FIG. 1 and depicting the typical mapping of pixels from the video RAM shown in FIG. 1 to the display;

DETAILED DESCRIPTION OF THE INVENTION

The preferred embodiment of the present invention and its advantages are best understood by referring to FIGS. 1–14 of the drawings, like numerals being used for like and corresponding parts of the various drawings.

Figure 1:
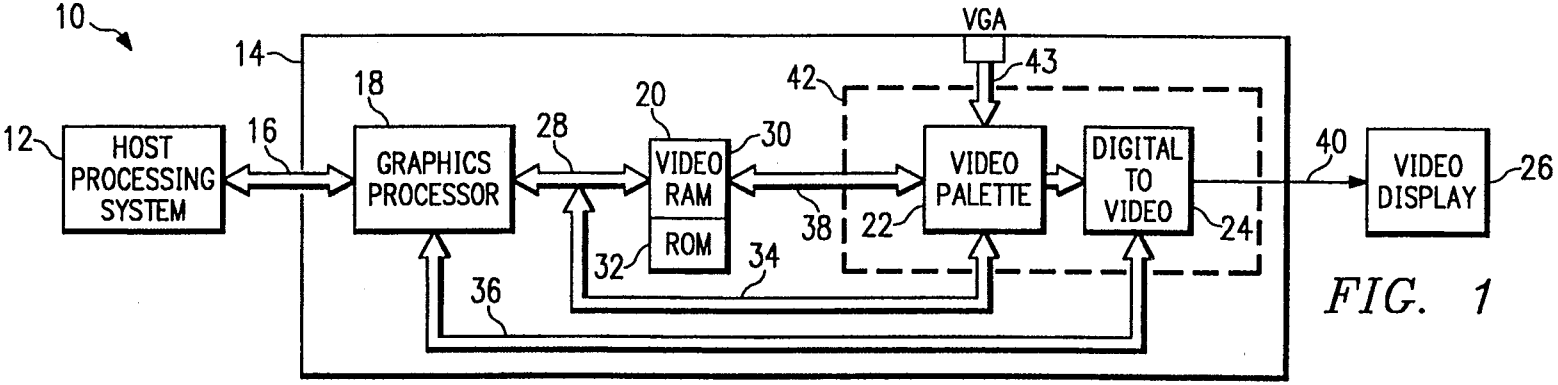
FIG. 1 is a functional block diagram of a graphics processor system utilizing one embodiment of the present invention.

Referring first to FIG. 1, a block diagram of a graphics computer system 10 is depicted as constructed in accordance with the principles of the illustrated embodiment of the present invention. For clarity and brevity in understanding the inventive concepts herein, a detailed description of the complete graphics processing system will not be provided. A more complete detailed discussion, however, can be found in U.S. Pat. No. 5,327,159, assigned to the assignee of the present application and hereby incorporated by reference. Also incorporated by reference herein are Texas Instruments TMS 34010 User's Guide (August 1988); TIGA340 TM Interface, Texas Instruments Graphics Architecture, User's Guide, 1989; TMS 34020 User's Guide (January 1990); TMS 44C251 Specification; TMS34010 Graphics System Processor Products Application Guide, Texas Instruments, 1988; Texas Instruments 340 Family Third Party Guide (June 1990); and Texas Instruments Graphics Systems Primer, 1989, all of which documents are currently available to the general public from Texas Instruments Incorporated. These documents give a more thorough description of graphics processing systems in general.

Graphics computer system 10 includes a host processing system 12 coupled to a graphics printed wiring board 14 through a bidirectional bus 16. Located on printed wiring board 14 are a graphics processor 18, memory 20, a video palette 22 and a digital-to-video converter 24. Video display 26 is driven by graphics board 14.

Host processing system 12 provides the major computational capacity for graphics computer system 10 and determines the content of the visual display to be presented to the user on video display 26. The details of the construction of host processing system 12 are conventional in nature and known in the art and therefore will not be discussed in further detail herein.

Graphics processor 18 provides the data manipulation capability required to generate the particular video display presented to the user. Graphics processor 18 is bidirectionally coupled to processing system 12 via bus 16. While graphics processor 18 operates as a data processor independent of host processing system 12, graphics processor 18 is fully responsive to requests output from host processing 12. Graphics processor 18 further communicates with memory 20 via video memory bus 28. Graphics processor 12 controls the data stored within video RAM 30, RAM 30 forming a portion of memory 20. In addition, graphics processor 18 may be controlled by programs stored in either video RAM 30 or in read-only memory 32. Read-only memory 32 may also include various types of graphic image data, such as alpha-numeric characters in one or more font styles, and frequently used icons. Further, graphics processor 12 controls data stored within video palette 22 via bidirectional bus 34. Finally, graphics processor 18 controls digital-to-video converter 24 via video control bus 36.

Video RAM 30 contains bit map graphic data which control the video image presented to the user as manipulated by graphics processor 18. In addition, video data corresponding to the current display screen are output from video RAM 30 on bus 38 to video palette 22. Video RAM 30 may consist of a bank of several separate random access memory integrated circuits, the output of each circuit typically being only one or 4 bits wide as coupled to bus 38.

Video palette 22 receives high speed video data from video random access memory 30 via bus 38 and data from graphics processor 18 via bus 34. In turn, video palette 22 converts the data received on bus 38 into a video level which is supplied to digital-to-video converter 24. This conversion is achieved by means of a look-up table which is specified by graphics processor 18 via video memory bus 34. The output of video palette 22 may comprise color, hue and saturation signals for each picture element or may comprise red, green and blue primary color levels for each pixel. Digital-to-video converter 24 converts the digital output of video palette 22 into the necessary analog levels for application to video display 26 via bus 40.

Printed wiring board 14 also includes a VGA pass-through port 43 coupled to palette 42. In the VGA pass-through mode, data from the VGA connector of a typical VGA-compatible personal computer is fed directly into palette 42 without the need for external data multiplexing. This allows a replacement graphics board to remain "downward compatible" by utilizing the existing graphic circuitry often located on the mother board of the associated host processing system 12.

Video palette 22 and digital-to-video converter 24 may be integrated together to form a "programmable palette" 42 or simply "palette" 42. The palette RAM, discussed below, is often referred to as the "look-up" table.

Video display 26 receives the video output from digital-to-video converter 24 and generates the specified video image for viewing by the user of graphics computer system 10. Significantly, video palette 22, digital-to-video converter 24 and video display 26 may operate in accordance with either of two major video techniques. In the first technique, video data are specified in terms of hue, saturation and brightness for each individual pixel. In the second technique, the individual primary color levels of red, blue and green are specified for each individual pixel. Upon selection of the desired design using either of these two techniques, video palette 22, digital-to-video converter 24 and video display 26 are customized to implement the selected technique. However, the principles of the present invention in regard to the operation of the graphics processor 18 are unchanged regardless of the particular design choice of the video technique. All of the signals that contribute to display color in some way are regarded as color signals even though they may not be of the red, blue, green technique.

Figure 2:
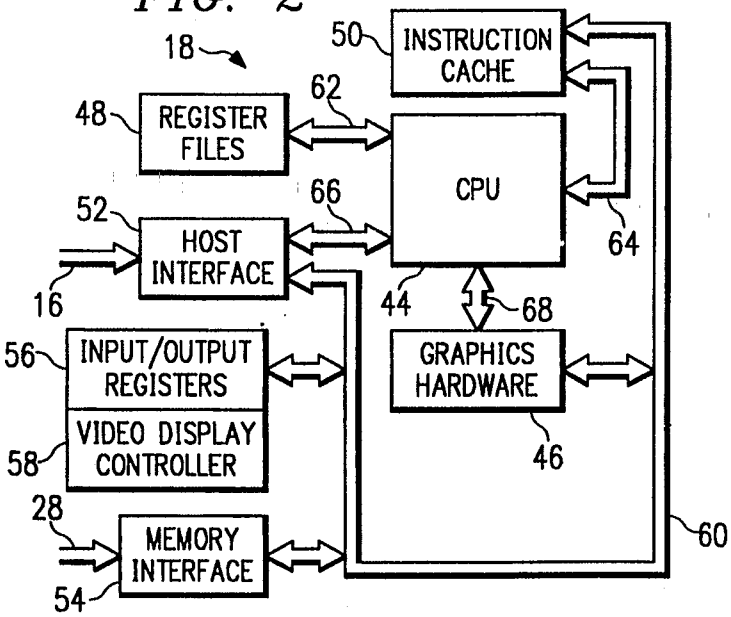
FIG. 2 is a more detailed functional block diagram of a graphics processor for use with the invention.

FIG. 2 generally illustrates graphics processor 18 in further detail. Graphics processor 18 includes central processing unit 44, graphics hardware 46, register files 48, instruction cache 50, host interface 52, memory interface 54, input/output registers 56 and video display controller 58.

The central processing unit 44 performs a number of general purpose data processing functions including arithmetic and logic operations normally included in a general purpose central processing unit. In addition, central processing unit 44 controls a number of special purpose graphics instructions, either alone or in conjunction with graphics hardware 46.

Graphics processor 18 includes a major bus 60 which is connected to most parts of graphics processor 18, including central processing unit 44. Central processing unit 44 is bidirectionally coupled to a set of register files 48, including a number of data registers, via bidirectional register bus 62. Register files 48 serve as the repository of the immediately accessible data used by central processing unit 44.

Central processing unit 44 is also connected to instruction cache 50 by instruction cache bus 64. Instruction cache 50 is further coupled to bus 60 and may be loaded with instruction words from video memory 20 (FIG. 1) via video memory bus 28 and memory interface 54. The purpose of instruction cache 50 is to speed up the execution of certain functions of central processing unit 44. For example, a repetitive function that is often used within a particular portion of the program executed by central processing unit 44 may be stored within instruction cache 50. Access to instruction cache 50 via instruction cache bus 64 is much faster than access to video memory 20 and thus, the overall program executed by central processing unit 44 may be sped up by a preliminary loading of the repeated or often used sequences of instructions within instruction cache 50.

Host interface 52 is coupled to central processing unit 44 via host interface bus 66. Host interface 52 is further connected to host processing system 12 via host system bus 16. Host interface 52 serves to control the communications between host processing system 16 and graphics processor 18. Typically, host interface 52 communicates graphics requests from the host processing system 16 to graphics processor 18, enabling host system 16 to specify the type of display to be generated by video display 26 and causing graphics processor 18 to perform a desired graphic function.

Central processing unit 44 is further coupled to graphics hardware 46 via graphics hardware bus 68. Graphics hardware 46 is additionally connected to major bus 60. Graphics hardware 46 operates in conjunction with central processing unit 44 to perform graphic processing operations. In particular, graphics hardware 46 under control of central processing 44 is operable to manipulate data within the bit map portion of video RAM 30.

Memory interface 54 is coupled to bus 60 and further coupled to video memory bus 28. Memory interface 54 serves to control the communication of data and instructions between graphics processor 18 and memory 20. Memory 20 includes both the bit map data to be displayed on video display 26 and the instructions and data necessary for the control and operation of graphics processor 18. These functions include control of the timing of memory access, and control of data and memory multiplexing.

Graphics processor 18 also includes input/output registers 56 and a video display controller 58. Input/output registers 56 are bidirectionally coupled to bus 60 to enable reading and writing within these registers. Input/output registers 56 are preferably within the ordinary memory space of central processing unit 44. Input/output registers 56 contain data which specify the control parameters of video display controller 58. In accordance with the data stored within the input/output registers 56, video display controller 58 controls the signals on video control bus 36 for the desired control of palette 42. For example, data within input/output registers 56 may include data for specifying the number of pixels per horizontal line, the horizontal synchronization and blanking intervals, the number of horizontal lines per frame and the vertical synchronization and blanking intervals.

Referring next to FIG. 3, a typical graphics memory system configuration for video RAM 20 is depicted in which eight VRAM memories 68 are used as an array, two of which are depicted as 68*a* and 68*b*. Each VRAM memory 68, or unit, includes four sections, or planes, 0, 1, 2 and 3. The construction of each plane is such that a single data lead 70 is used to write information to that plane. In a system which uses a 32-bit data bus, such as data bus 28, there would be eight VRAM memories, each VRAM memory having four data leads connected to the input data bus. For example, for 32-bit data bus 28, VRAM memory 68*a* would have its four data leads 70 connected to data bus 28 leads 0, 1, 2, and 3, respectively. Likewise, the next VRAM memory 68*b* would have its four leads 0, 1, 2, and 3 connected to data bus 28 leads 4, 5, 6, and 7, respectively. This pattern continues for the remaining six VRAMs such that the last VRAM has its leads connected to leads 28, 29, 30, 31 (not shown) of bus 28.

The VRAM memories 68 are arranged such that the pixel information for the graphics display is stored serially across the planes in the same row. Assuming a 4-bit per pixel system, then the bits for each pixel are stored in separate VRAM memory. In such a situation, pixel 0 would be the first VRAM 68*a* and pixel 1 would be the second VRAM 68*b*. The pixel storage for pixels 2–7 are not shown, but these would be stored in column 1 of VRAMS 68*c, d, e, f, g* and *h*. The pixel information for pixel 8 would be stored in the first VRAM 68*a*, still in row A, but in column 2 thereof.

Each VRAM plane has a serial register 72 for shifting out information from a row of memory. In the preferred embodiment, the shifting out is performed in response to a shift clock signal SCLK (not shown) generated on palette 42 (FIG. 1). The outputs from these registers are connected to bus 38 in the same manner as the data input leads are connected to input bus 28. Thus, data from a row memory, such as row A, would be moved into register 72 and output serially from each register 72 and in parallel on bus 38. This would occur for each plane of the eight VRAM memory array.

The memory configuration depicted in FIG. 3 is not limited to the handling of 4-bit pixel description data. For example, if the information for each pixel was to be described in eight bits, then two VRAMs 68 would be required to store per pixel. Further, for increased ability in handling data, shift registers 72 would be split in half with each half used to output data onto bus 38. The split register approach allows for differences in the number of pixels required by the display and the number of bits per pixel desired. A more complete description of this feature can be found in co-assigned application Ser. No. 544,775 (Attorneys' Docket No. TI-15123) and hence, will not be repeated here.

Returning to FIGS. 1 and 2, graphics processor 18 operates in two different address modes to address memory 20. These two address modes are X-Y addressing and linear addressing. In linear addressing, a pixel is designated by its starting address in memory. The pixel size is determined by the data within a register within central processing unit 44. In X-Y addressing, a pixel is designated by its X and Y coordinate values on the display.

It is important to note that in any event, graphics processor 18 may manipulate data to provide for a variable number of pixels as required by the associated display 26 as well as a variable number of data bits per pixel in each color code. This provides increased flexibility in terms of the size and resolution of display 26 and the number of possible colors available for a given pixel. As will be discussed below in further detail in conjunction with the description of the color palette 42, graphics processor 18 in the illustrated embodiment outputs 32-bit color code words, each of which may be interpreted by the palette as thirty-two 1-bit, sixteen 2-bit, eight 4-bit, or four 8-bit pixels. Each n-bit pixel in turn selects one of $2^n$ entries in the look-up table. For the case of n less than eight, a page register within the palette device supplies the remaining 8-n bits of the 8-bit address necessary to uniquely designate a particular one of the 256 entries in the look-up table.

Figure 4:
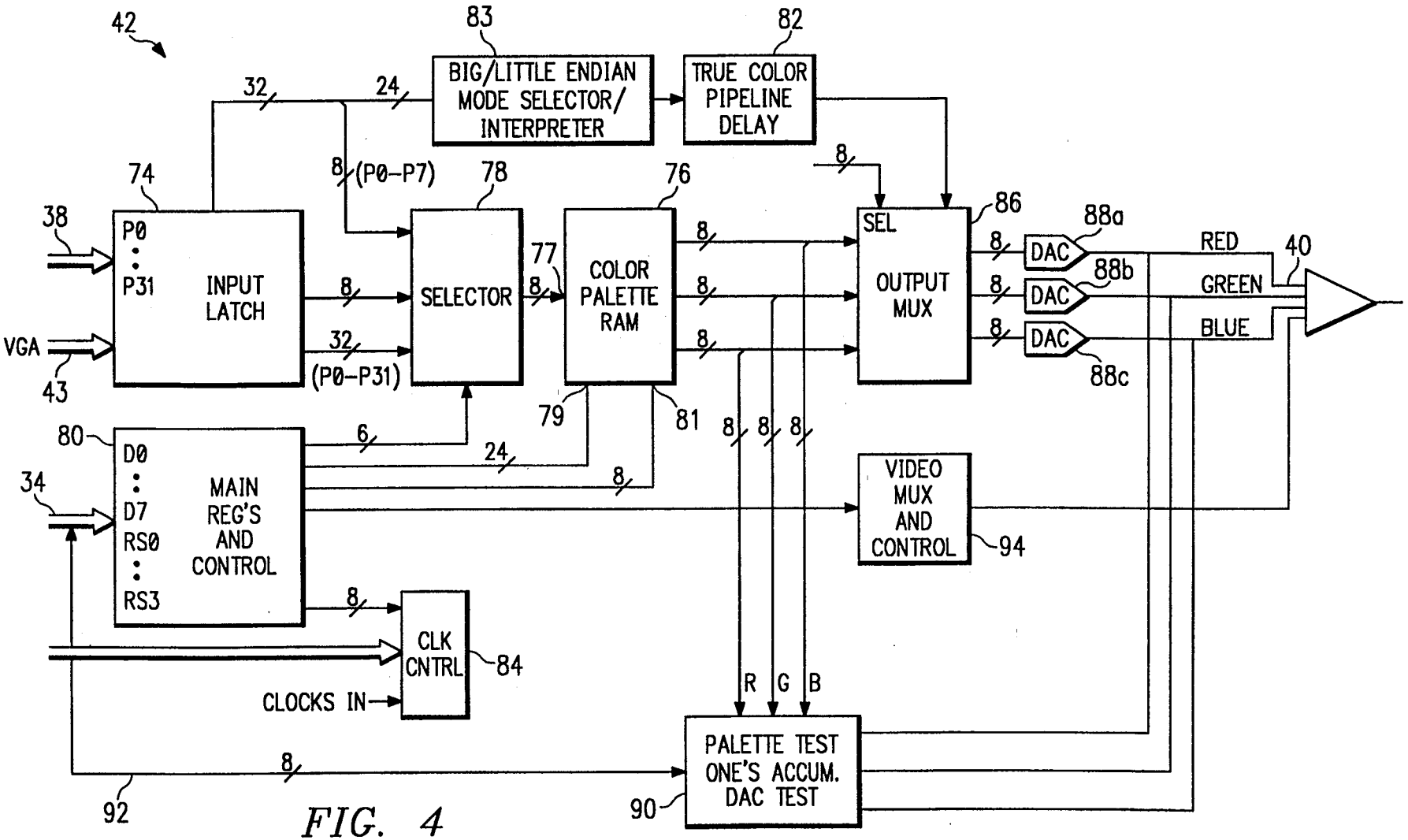
FIG. 4 is a functional block diagram of a video palette depicted in FIG. 1.

FIG. 4 is a more detailed depiction of palette 42 emphasizing the color palette RAM and the circuitry controlling it. Palette 42 includes an input latch 74 coupled to video memory 20 (FIG. 1) via bus 38. In the illustrated embodiment, input latch 74 receives color codes output from eight VRAM memories 68 comprising video RAM memory 30. Color palette RAM 76 provides color data words in response to color codes received at input latch 74. Selector 78 couples color palette RAM 76 and input latch 74, in the illustrated embodiment receiving 32 bits of color code data from latch 74 and outputting 8-bit words of address data to color palette RAM 76.

In the depicted example, RAM 76 is of a 256K×24-bit architecture with each 8-bit address outputting a 24-bit word. The 24 bits output can then provide three 8-bit words of red, blue or green data for conversion and output by digital-to-analog converters 88. In the illustrated embodiment, color palette RAM 76 is a high-speed dual-port static RAM (SRAM); however, color palette RAM 76 may also be implemented using dynamic random access memories (DRAMs).

Graphics processor 18 (FIG. 2) controls the contents of the color data words output to video display 26 in response to color codes received at latch 74 by the writing and reading of color data words to and from color palette RAM 76 using main registers and control circuitry 80 and bus 34. Preferably, the ports 79 and 81 of a dual-port RAM are used for this data revision/update function. When a 256×24-bit memory is used, red, green and blue data are written in as a concatenated 24-bit word to port 79 word with an 8-bit address provided to port 81 determining the memory location. Palette 42 also includes clock control circuitry 84, output multiplexer 86 and digital-to-analog converters 88*a*, 88*b* and 88*c*. Also depicted in FIG. 4 are palette test and accumulator registers 90, and video multiplexer and control circuitry 94. For a more complete description of these components, reference is made to U.S. Pat. Nos. 5,327,159 and 5,309,173, and pending U.S. patent application Ser. Nos. 07/734,344 and 08/223,380 TI-15776 and TI-16453 incorporated herein by reference. True color pipeline delay 82 and big/little-endian mode bit selector circuitry 83 will be discussed more specifically below.

Color palette 42 is further operable in a true-color mode. In the illustrated embodiment in which 32-bit color codes are received on bus 38 from video RAM 30, 24 bits are transferred directly from input latch 74 to digital-to-analog converters 88 through output multiplexer 86. The remaining 8 bits of the 32-bit color code are passed to selector 78 to provide an address to color palette 76 for the output of pixels for an overlay on video display 26. For a given pixel, graphics processor 18 can select between the true-color data or the overlay data using output multiplexer 86. True-color pipeline delay 82 provides for the proper synchronization of the of data directly fed to output multiplexer 86 and he overlay data output from color RAM 76 as addressed by the remaining bits of color code word. True-color pipeline delay 82 performs this function by adding one latch delay, through clocked flip-flops, to the true-color data for every pipeline delay seen by the used for the overlay address to RAM 76. In the illustrated embodiment, when the 8 bits addressing of the overlay are a non-zero value, the 24 bits of red, blue, and green data output from color palette RAM 76 location addressed by the eight bits are passed to digital-to-analog converters 88*a*, 88*b* and 88*c*. When the 8-bit overlay address is equal to 0, however, then the 24 bits of red, green, and blue true-color data bypassing color palette RAM 76 are provided to digital-to-analog converters 88 for output to display 26.

Figure 5:
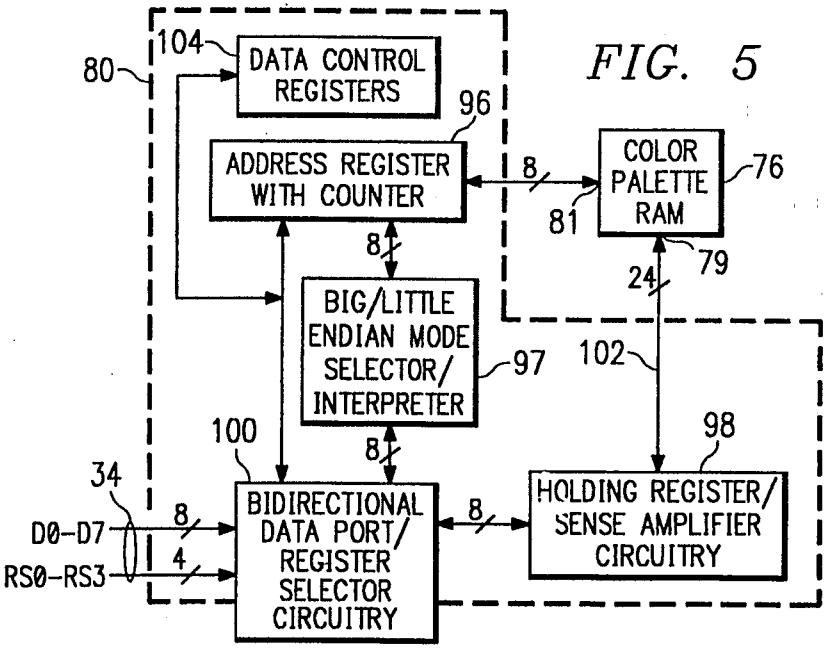
FIG. 5 is a more detailed functional block diagram of portions of the video palette shown in FIG. 4, emphasizing the color palette RAM and associated circuitry for reading and writing into data locations in the look-up table therein.

FIG. 5 is a more detailed block diagram depicting the portions of registers and control circuitry 80 (represented in FIG. 5 by the dashed enclosure) which control the reading and writing of color data words into the desired locations in color palette RAM 76. Register-select data is received on inputs RS0-RS3 controlling the selection of the particular register in the register map, in this case address register 96. Address data and red, green and blue color data are transferred into address register 96 and RAM 76 through inputs D0-D7. To load color palette RAM 76, graphics processor 18 first writes to address register 96 (write mode) through big/little-endian mode selector/interpreter circuitry 97 with the address at which the modification is to start. The operation of the big/little-endian mode selector-/interpreter circuitry 97 will be discussed in further detail below. This step is then followed by three successive writes to the palette holding register/sense amplifier circuitry 98 with eight bits each of red, green and blue data. After the blue (last) write cycle, the three bytes of color are concatenated into a twenty-four bit word and then written into the RAM location specified by the 8-bit address being held in the address register 96. The address register 96 then automatically increments to the address for the next location, which graphics processor 18 may modify by simply writing another sequence of red, green, and blue data. A block of color values in consecutive locations may be written by writing the start address into address register 96 and performing continuous red, green, and blue write cycles and address increments until the entire block has been written.

Reading from color palette RAM 76 is performed by writing to the address register 96 (read mode), through big/little-endian mode selector/interpreter circuitry 97 (discussed below), the address of the location to be read, which initiates a transfer of 24 bits from the palette RAM 76 into the holding register/sense amplifier circuitry 98. This is also followed by an automatic increment of the address register 96. Three successive reads from the holding register 98 will produce red, green, and blue color data (six or eight bits each depending on the desired operating mode) for the specific location. Following the blue read cycle (the last output of data), the contents of the color palette RAM 76 at the new address specified by the address register 96 are copied into the holding register/sense amplifier circuitry 98 and address register 96 is again incremented. As with writing to the palette, a block of color values in consecutive locations may be read by writing the start address and performing continuous red, green, and blue read cycles on address increments until the entire block has been read.

For a more detailed description of register control circuitry 80 and the preferred methods of reading and writing color data words into color palette RAM 76, refer to co-assigned U.S. patent application Ser. No. 08/223,380, a continuation of U.S. patent application Ser. No. 07/720,100 now abandoned.

FIG. *6a–f* are complete schematic diagrams of selector 78. In the preferred embodiment, selector 78 receives 32 bits of red, green and blue color codes from video RAM 34 via latch 74 and outputs four corresponding 8-bit addresses to port 77 of RAM 76. In the preferred embodiment, when operating in the true-color mode, selector 78 receives the 8 bits for the overlay address to RAM 76. It is important to recognize however that numerous configurations are possible, such as varying the numbers of input bits and output bits that can be handled. In the preferred embodiment, selector 78 is configurable to receive color codes of 1, 2, 4, 8, 16 or 32 bits and to output a corresponding number of 1-, 2-, 4-, or 8-bit addresses, each addressing a location in RAM 76, in response.

Selector 78 includes a bank of 2:1 multiplexers 106 each of which has an A data input coupled to a respective input P. In the preferred embodiment, 32 multiplexers 104 are provided which transfer 32 bits of address data (color codes) that arrive at the inputs $P_0$–$P_{31}$ to a corresponding bank of 32 latches 108. The multiplexers pass data from the A inputs to the multiplexer outputs on the rising edge of signal LD and then hold the data until the next DOT clock arrives. The dot clock signal DOT latches the 32-bit word from multiplexers 106 into the bank of 32 latches 108 and, at the same time, toggles control signal LD, thereby switching the 2:1 multiplexers to select the B data inputs.

The B inputs of 2:1 multiplexers 106 are fed from an array of transmission gates configured in four groups comprising 8-, 4-, 2-, and 1-bit sections. In the illustrated embodiment, each word of color codes from video RAM 30 comprises a 32-bit word which may provide either thirty-two 1-bit, sixteen 2-bit, eight 4-bit or four 8-bit addresses to RAM 76, each address accessing a look-up table location for a given pixel. The array of transmission gates provide for the variable number of address bits per pixel for a given word color codes from RAM 30. Transmission gates 110 comprise the 1-bit section, transmission gates 112 comprise the 2-bit section, transmission gates 114 comprise the 4-bit section and transmission gates 116 comprise the 8-bit section. The 1-bit section allows shifting and output of 1-bit addresses per each pixel, the 2-bit section shifting and output of 2-bit addresses per pixel, and so on. One set of transmission gates 110-116 is activated at any one time.

The inputs of transmission gates 110-116 are respectively coupled to the Q outputs of the 32-latch bank of latches 108. Each successive row of transmission gates is fed from the latches 108 of the rows below such that data can be shifted upward toward the least-significant bit MD0 (the "LSB"). Since a new 32-bit word arrives and is switched through selector 78 with every LD, each DOT clock is used to shift groups of data upward through the active transmission gate group during the interval between each rising edge of LD (the "LD clock interval"). Thus, if transmission gates 110 (the 1-bit group) are activated the data are shifted up by 1 bit, if transmission gates 112 are activated (the 2-bit group) the data are shifted up 2 bits, if transmission gates 114 are activated (the 4-bit group) the data are shifted up 4 bits, and if transmission gates 116 (the 8-bit group) are activated the data are shifted up 8 bits.

In the preferred embodiment, the 8-bit address output of selector 78 to color palette RAM 76 is made through a bank of eight latches 118 that are also clocked by clock signal DOT. Each DOT clock that initiates an upward data shift also latches and outputs the 8-bit result of the previous shift through latches 118. Note that in the preferred operating mode, a continuous flow of the 32-bit words of color codes is received by selector 78. For high-speed operation therefore, the first DOT after signal LD not only latches the new 32-bit word into latches 108, but it also latches and outputs the last 8-bit word address of the last 32-bit word received.

Selector 78 always outputs an 8-bit address regardless of the number of bits of color data output per pixel. A page register (not shown) is therefore used as the source of the missing most-significant bits of any given address when the number of bits per address word output is less than 8.

Figure 6A:
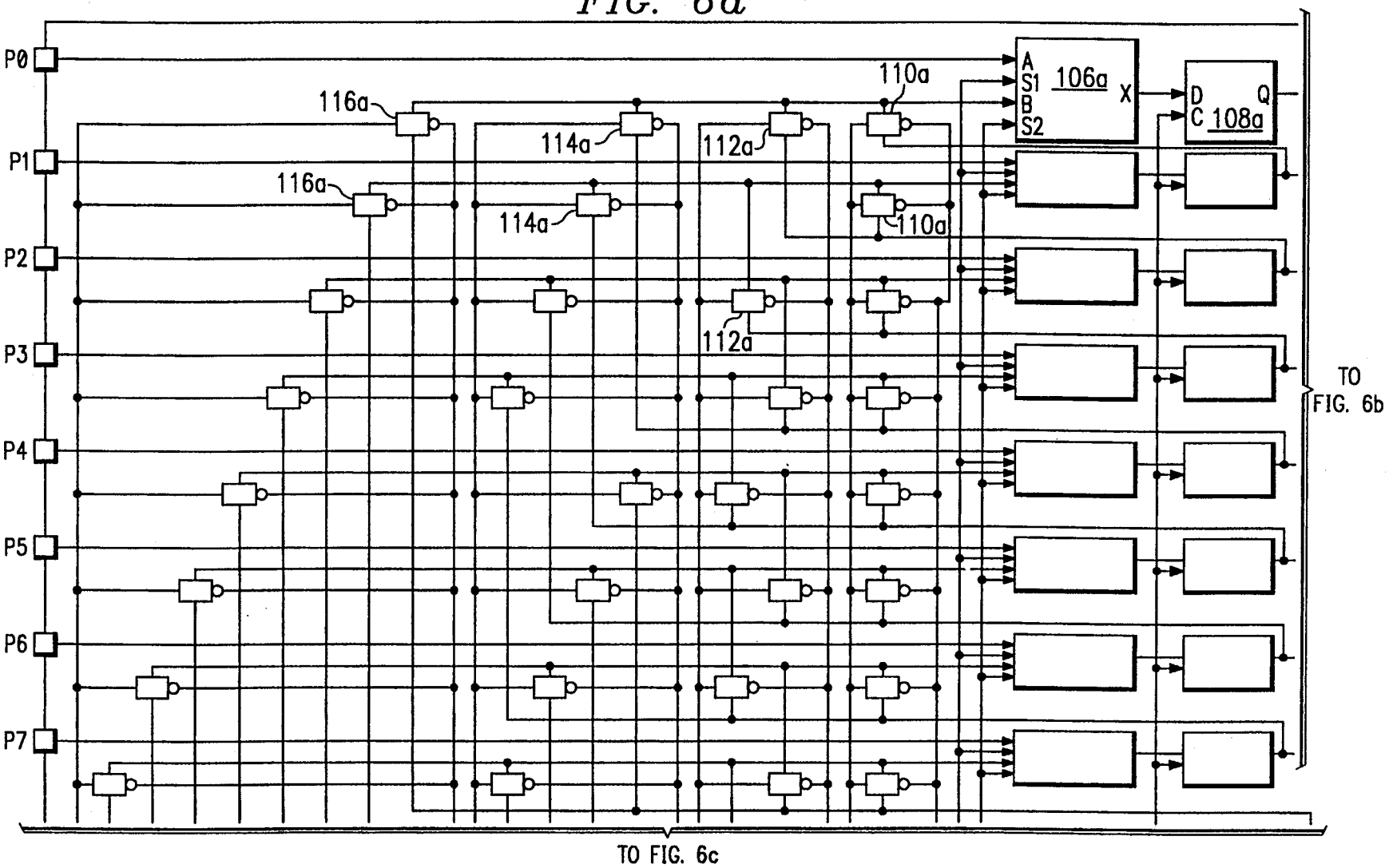
FIG. 6*a* throughout 6*f* is an electrical schematic diagram of the selector shown in FIG. 4.
Figure 6B:
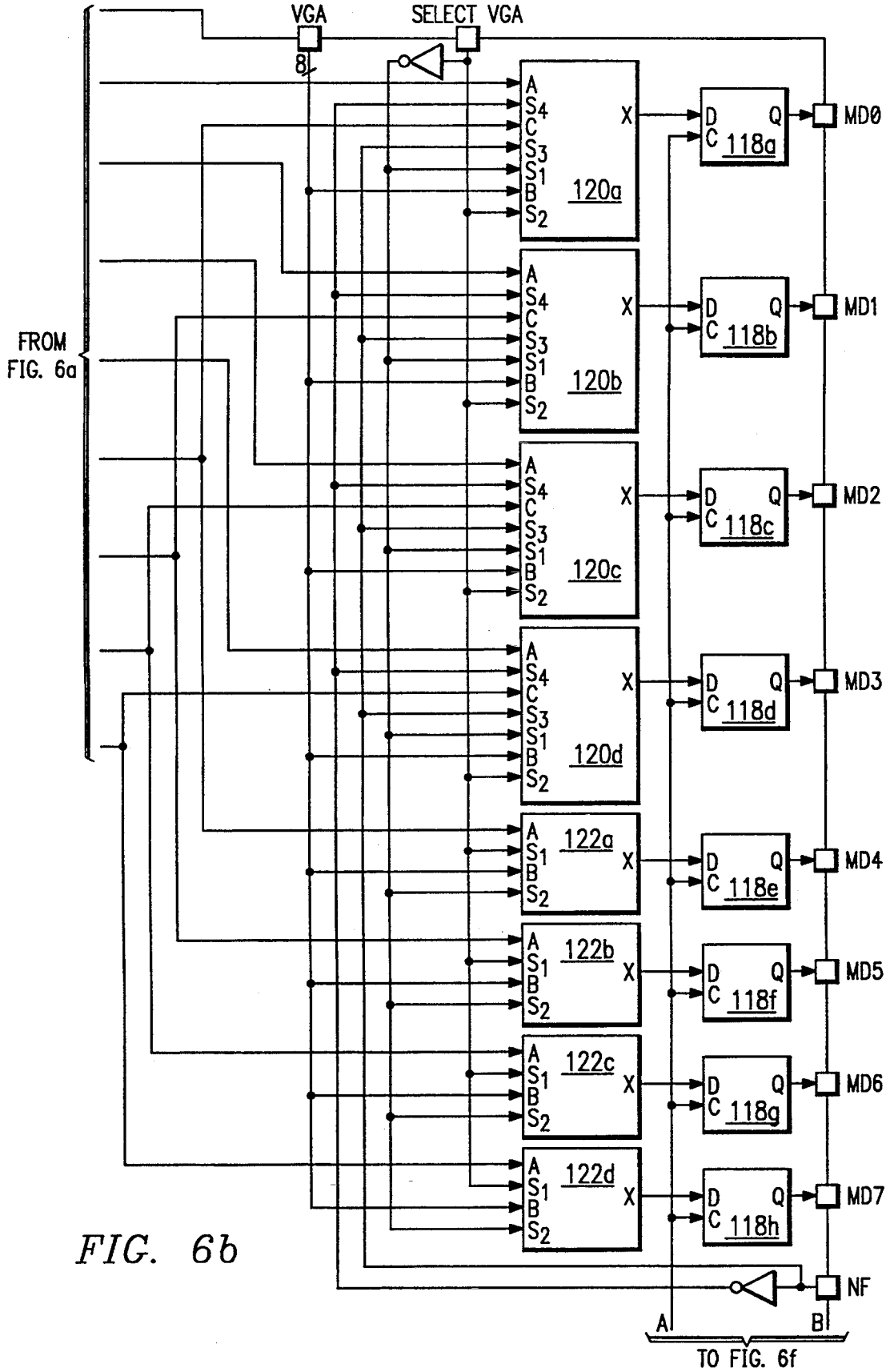
Figure 6C:
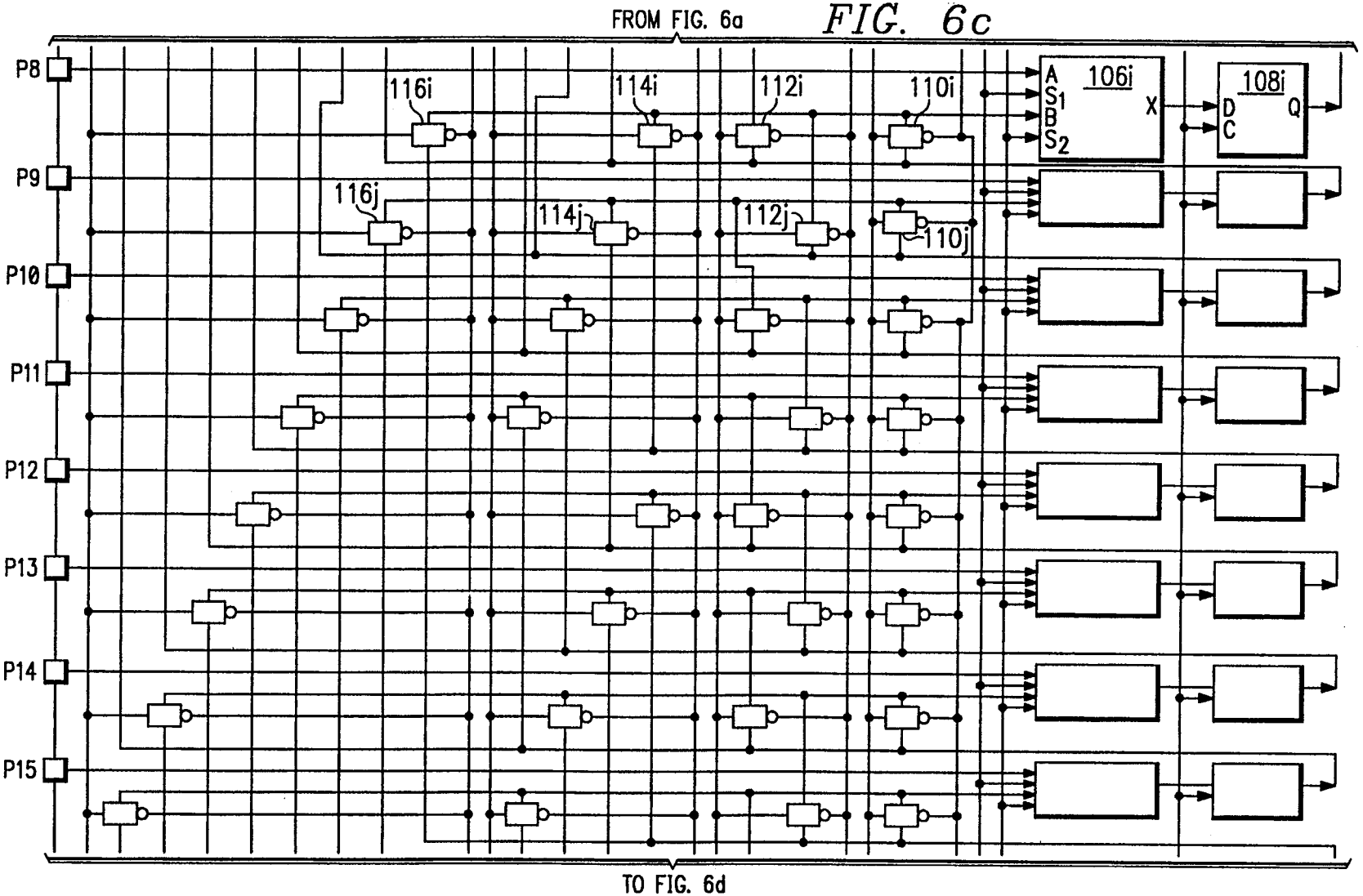
Figure 6D:
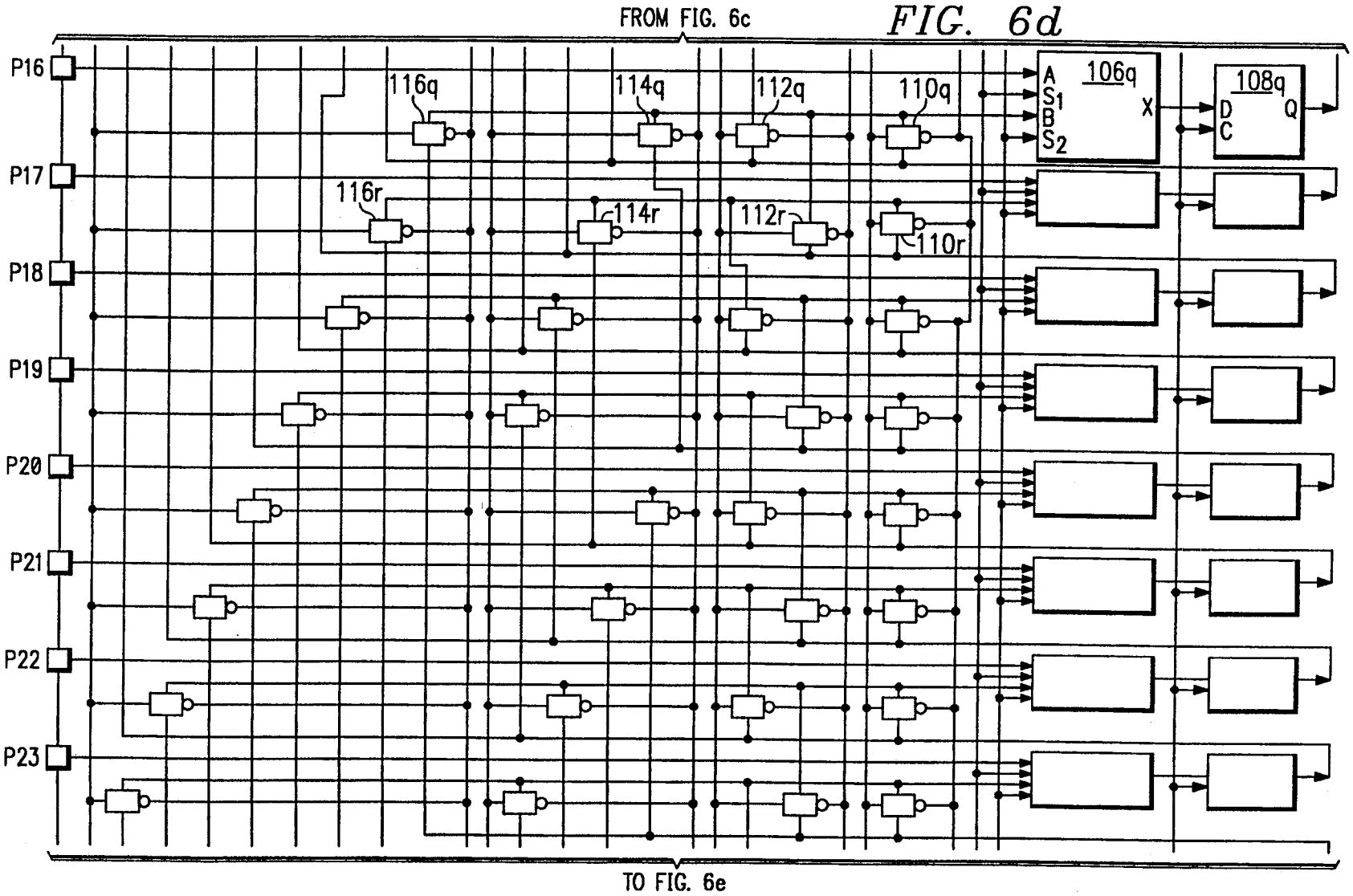
Figure 6E:
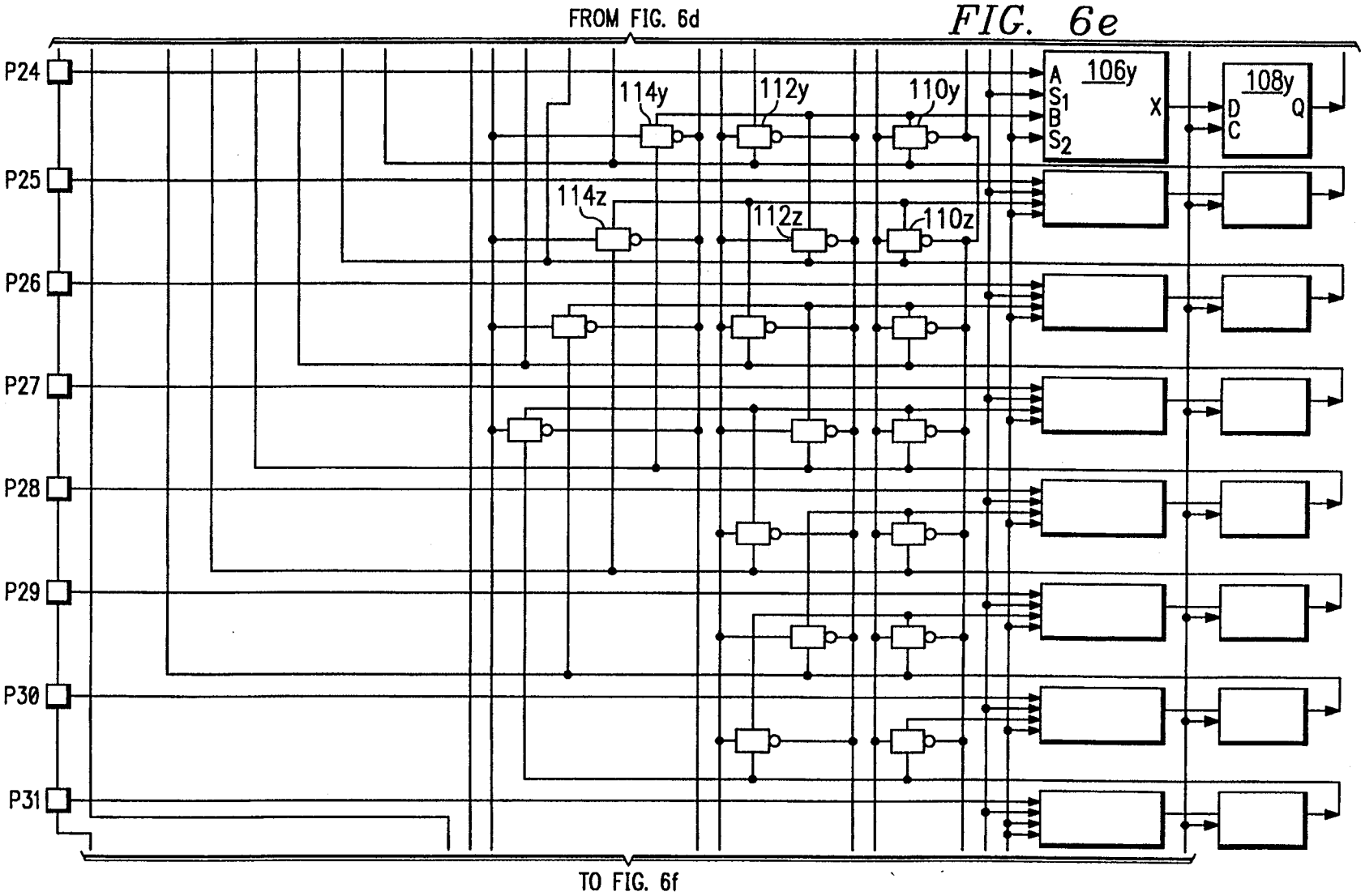
Figure 6F:
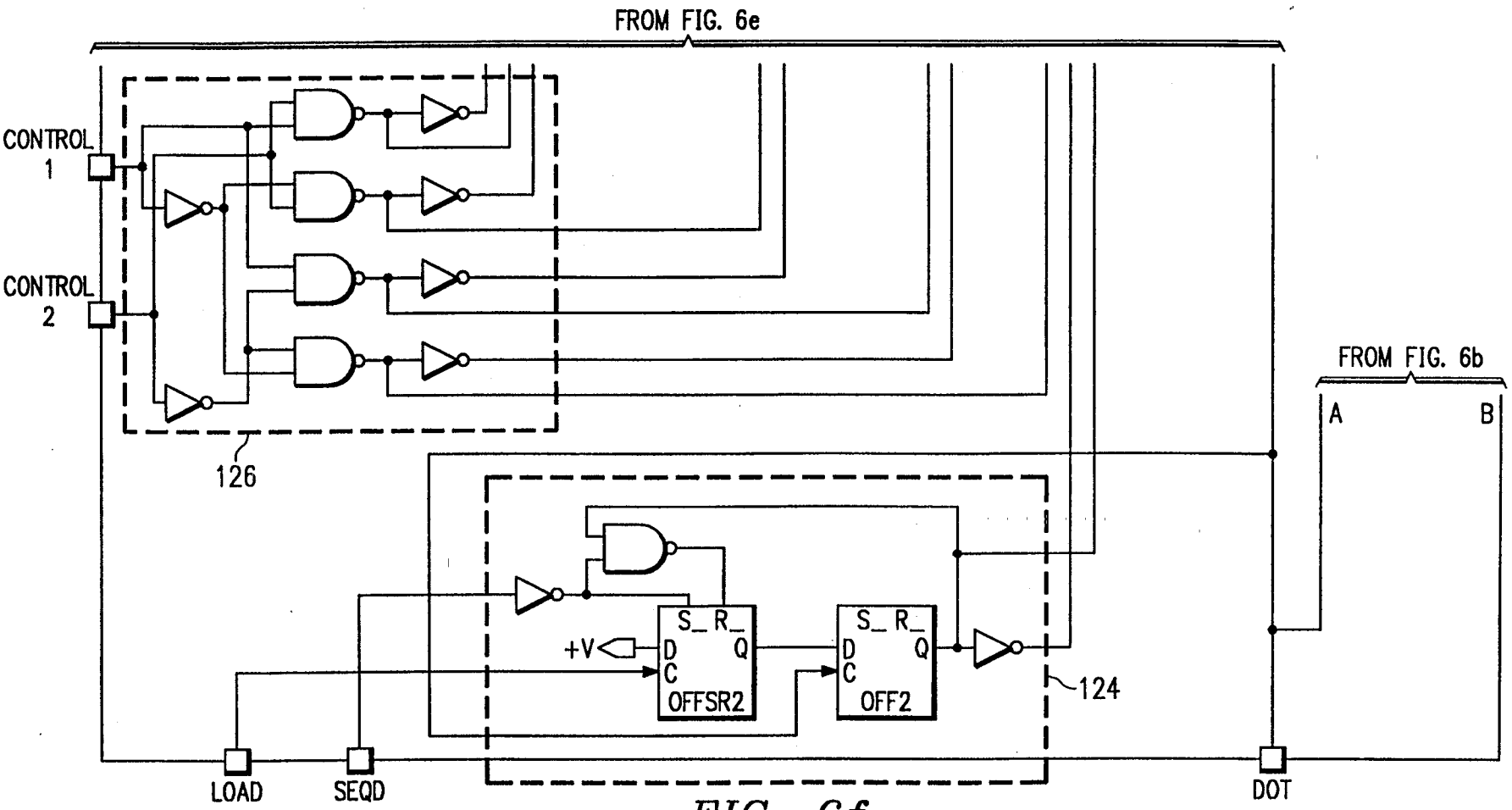

FIG. 6 further depicts a second set of multiplexers, including 3:1 multiplexers 120 (see, e.g., FIG. 6*b*) and 2:1 multiplexers 122 (FIG. 6*b*), multiplexer control circuitry 124 (FIG. 6*f*) and transmission gate control circuitry 126 (FIG. 6*f*). Multiplexers 118 and 120 are operable to switch VGA pass through signals directly to the outputs $MD_0$-$MD_7$ and provide for the "special nibble mode". For a complete description of the operation of these circuits as well as a more complete description of the operational timing of selector 78, reference is now made to co-pending and co-assigned U.S. Pat. No. 5,309,873 incorporated herein by reference.

Referring next to FIG. 7, the mapping of color codes from video RAM 30 to video display 26 is depicted for both the big- and little-endian modes. Again, in the illustrated embodiment, each pixel comprises 8 bits such that each 32-bit color code output from video RAM 30 contains four 8-bit pixels, which in this example, appear in adjacent positions on the same horizontal scan line on video display 26. The four pixels, designated as B0-B3, always appear from left to right in the order B0, B1, B2, B3. In the little-endian machine, pixel B0 is stored at the least-significant end of the word, while in the big-endian machine, pixel B0 is stored at the most-significant end.

Figure 8:
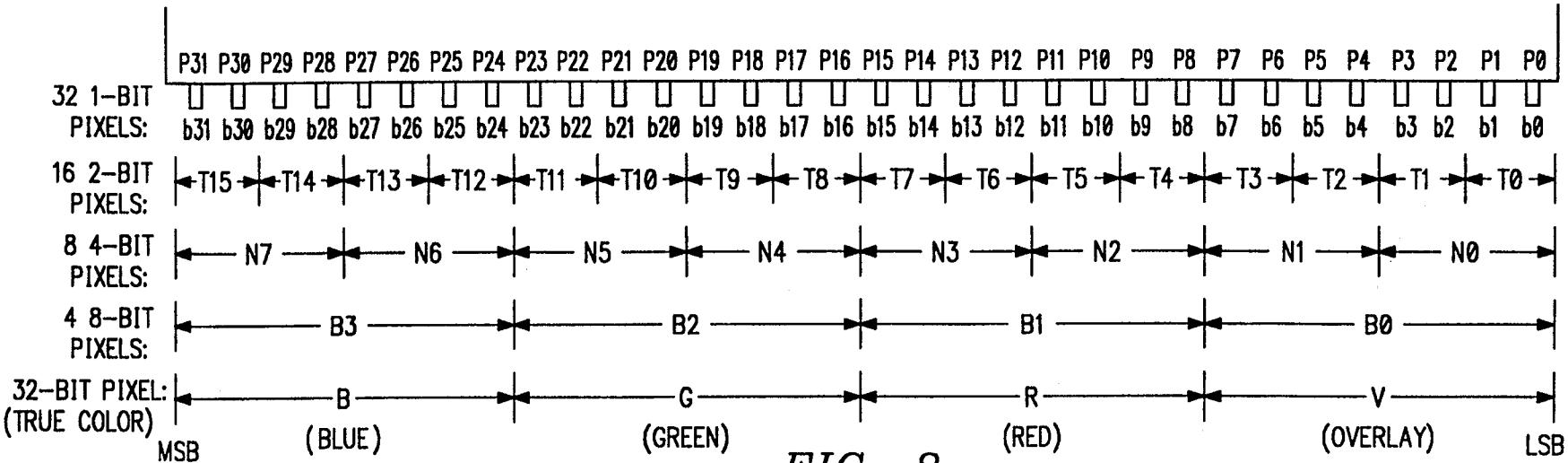
FIG. 8 is a diagram showing the mapping of data from the video RAM 30 of FIG. 1 to the inputs of the color palette of FIG. 4 as interfaced in the little-endian Format.

FIG. 8 depicts the mapping of 1-, 2-, 4-, 8-, and 32-bit pixels from each 32-bit word received from the video RAM 30 (FIG. 1) to inputs (pins) P0-P31 as ordered in the little-endian format. In FIG. 8, the 32 single-bit pixels have been designated b0-b31, the 16 2-bit pixels designated T0-T15, the eight 4-bit pixels designated N0-N7, and the four 8-bit pixels designated B0-B3. The one 32-bit pixel depicted is comprised of 8 bits each of red, green, and blue true-color data along with 8 bits of overlay address data in RAM 76. When displayed on video display 26, the single-bit pixels b0-b31 appear next to each other on the same scan line in the order b0, b1, . . . , b31 from left to right. Similarly, 2-bit pixels T0-T15 appear left to right in the order T0, T1, . . . , T15; the 4-bit pixels N0-N7 appear left to right in the order N0, N1, . . . , N7, and so on.

For the 1-, 2-, 4-, and 8-bit pixels, each pixel value is interpreted by selector 78 as an index into the internal look-up table held in RAM 76, as discussed above. For example, for 8 bits per pixel, pixel B0 is an index that selects one of the 256 palette locations in color palette RAM 76 in the illustrated embodiment. The most-significant bit of pixel B0 is received on input (pin) P7 and the least-significant bit (LSB) on input P0.

Figure 9:
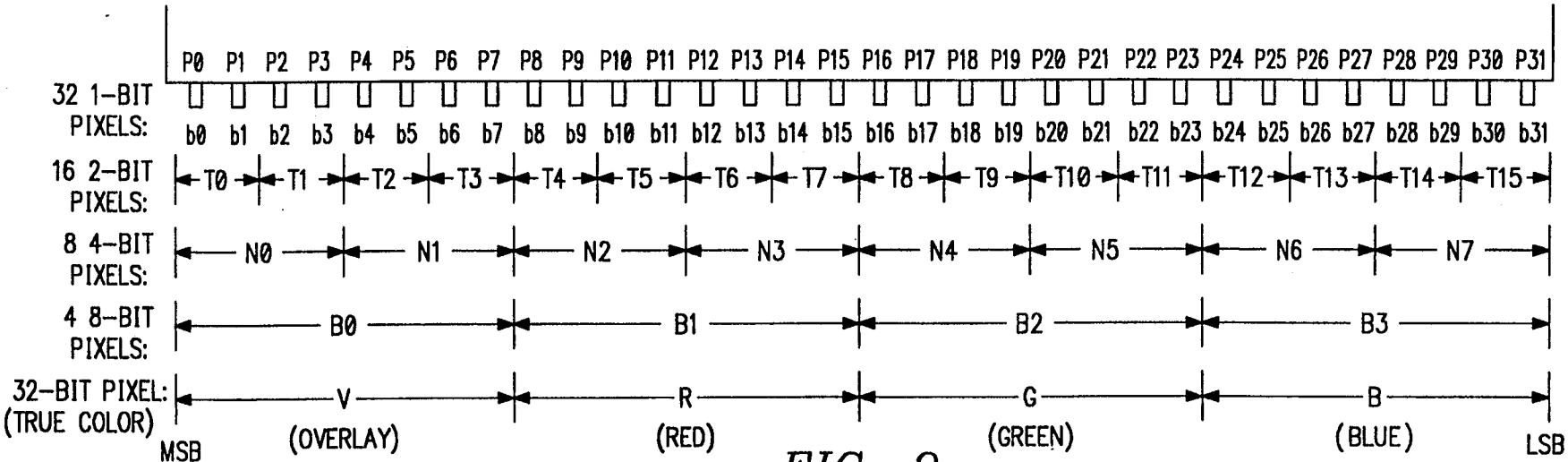
FIG. 9 is a diagram showing the mapping of data from the video RAM 30 of FIG. 1 to the inputs of the color palette of FIG. 4 as interfaced in the big-endian Format.

FIG. 9 depicts the mapping of 1-, 2-, 4-, 8-, and 32-bit pixels from video RAM 30 (FIG. 1) to the inputs (pins) P0-P31 of color palette 42 arranged in the big-endian format. Again using pixel B0 (where 8 bits are provided per pixel) as an example, the most-significant bit (MSB) of pixel is now received at input (pin) P0 and the least-significant bit (LSB) is coupled to input P7.

In order to account for the difference in ordering of the bits received at pins P0-P31 when color palette 42 is coupled to a graphics processor 18 operating in either the big- or little-endian modes, selector/interpreter circuitry 83 is provided in the true-color bypass path and bit/little-endian selector/interpreter 97 is provided in the register and control circuitry 80. Big/little-endian mode bit 83 (FIG. 4) selector/interpreter circuitry 83 (FIG. 4) is available to selectively mirror the 24 bits of red, green and blue true-color data being directly passed to output multiplexer 86. In the illustrated embodiment, the normal operating mode on a default format is assumed to be the little-endian mode and mirroring is performed to convert to the big-endian mode. In alternate embodiments, however, the same bit-mirroring circuit can as readily mirror data normally received in the big-endian format and conversion to the little-endian format is required for compatibility with other components operating in the little-endian format. Big/-little-endian mode selector/interpreter circuitry 97 (See FIG. 5) is similarly available to the address to color palette RAM 76 used to read and write color data words into selected color palette locations for later recall by the address from selector 78. Big/little-endian mode selector/interpreter circuitry 97 essentially "renames" each of the 256 palette locations forming the look-up table of color palette RAM 76 in order to compensate for the reversal of the address bits that naturally occurs at inputs P0-P31 when the system operating mode is big-endian rather than little-endian of the illustrated embodiment. For example, if a particular palette location inside color palette RAM 76 is identified by an 8-bit address HGFEDCBA in little-endian mode, it is identified by the address ABCDEFGH in the big-endian mode. Thus, when color palette 42 is coupled to a big/little-endian modes processing system, big/little-endian mode selector/interpreter circuitry 97 simply reverses the addresses to the palette locations in color palette RAM 76. Color data words are input into the "renamed" palette locations from graphics processor 18 according to the big/little-endian mode that processor 18 is operating in. Note that in the preferred embodiment, circuitry similar to big/little-endian selector/interpreter circuitry 97 is not used to reverse the corresponding recall addresses provided through selector 78 to RAM 76 to achieve the same result. The path formed by input latch 74, selector 78 and RAM 76 is the "high speed" path or "critical" path such that any timing delays caused by the addition of big/little-endian selector/interpreter circuitry 97 to that path may degrade system performance.

Figure 10:
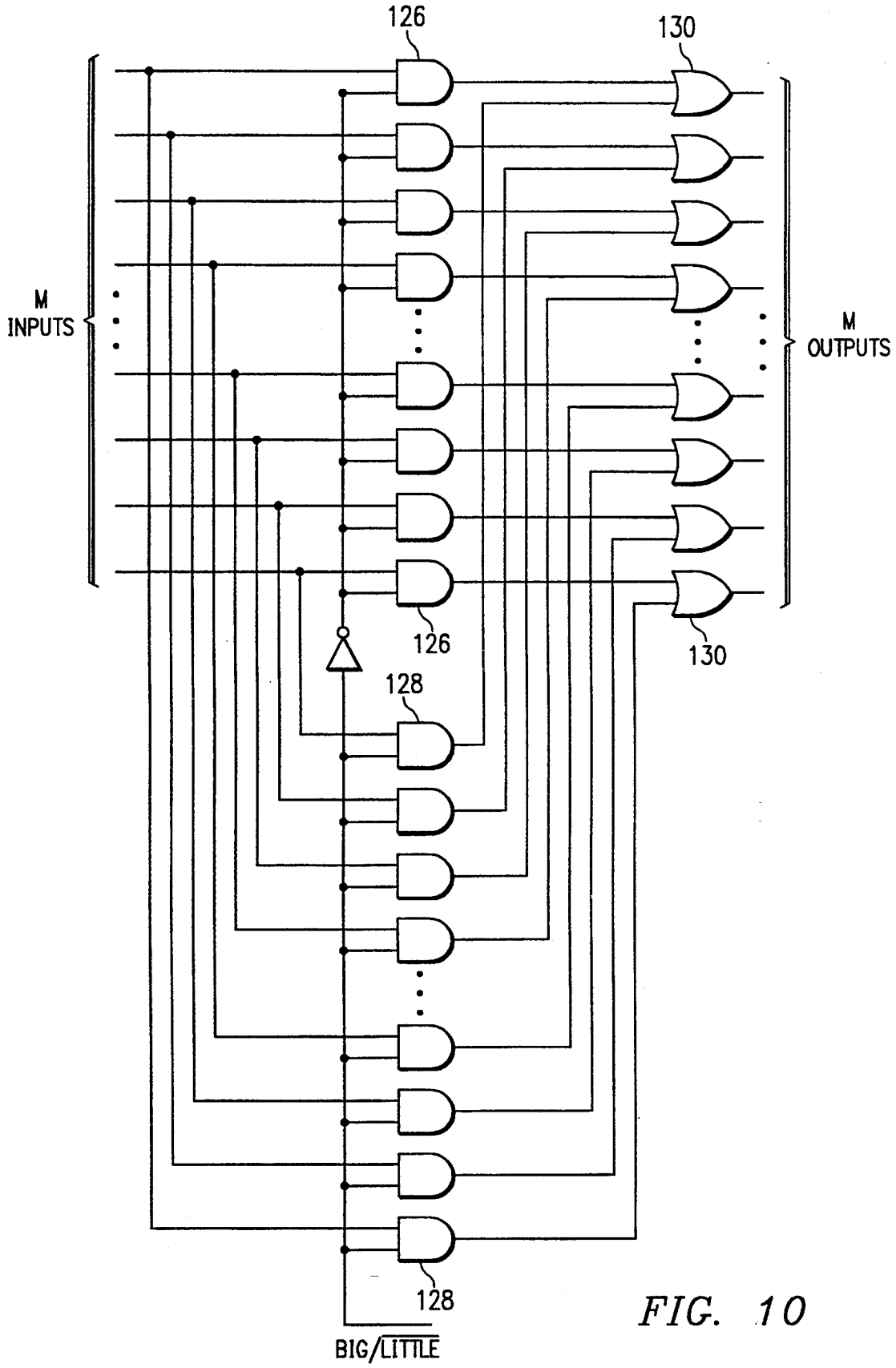
FIG. 10 is an electrical schematic diagram depicting big little-endian selector/converter circuitry according to the present invention.

Referring next to FIG. 10, a simplified diagram depicts the bit-mirroring multiplexer circuitry used in both big/little-endian mode selector/interpreter circuits 83 and 97. The circuit of FIG. 10 is flexible, allowing any number of bits to be mirrored depending on the requirements of the remaining circuitry. Again, for illustration purposes only, the circuitry of FIG. 10 is assumed to be operating in conjunction with a color palette configured for the little-endian mode, however, the same circuitry can as easily be used to mirror big-endian inputs into the little-endian format. When data is received in the little-endian format, control signal BIG/$\overline{\text{LITTLE}}$ is set low and consequently the data is passed directly through AND gates 126 without mirroring and output through OR gates 130. When data is received in the big-endian format, however, control signal big/little-endian is set high and the data is mirrored by AND gates 128 before being output by OR gates 130.

In the embodiment shown in FIG. 4, big/little-endian mode selector/interpreter circuitry 83 comprises 24 first AND gates 126, 24 second AND gates 128, and 24 OR gates 130, allowing mirroring of all 24 bits of red, green and blue true-color data being passed through the true-color bypass path such that the bypass path becomes compatible with overall system operating the big-endian mode. Similarly, in the illustrated embodiment, big/little-endian selector/interpreter circuitry 97 (FIG. 5) comprises 8 first AND gates 126, 8 second AND gates 128 and 8 OR gates 130, allowing mirroring of all 8 bits the read/write addresses being provided to 96 address register controlling the look-up table of RAM 76.

Figure 11:
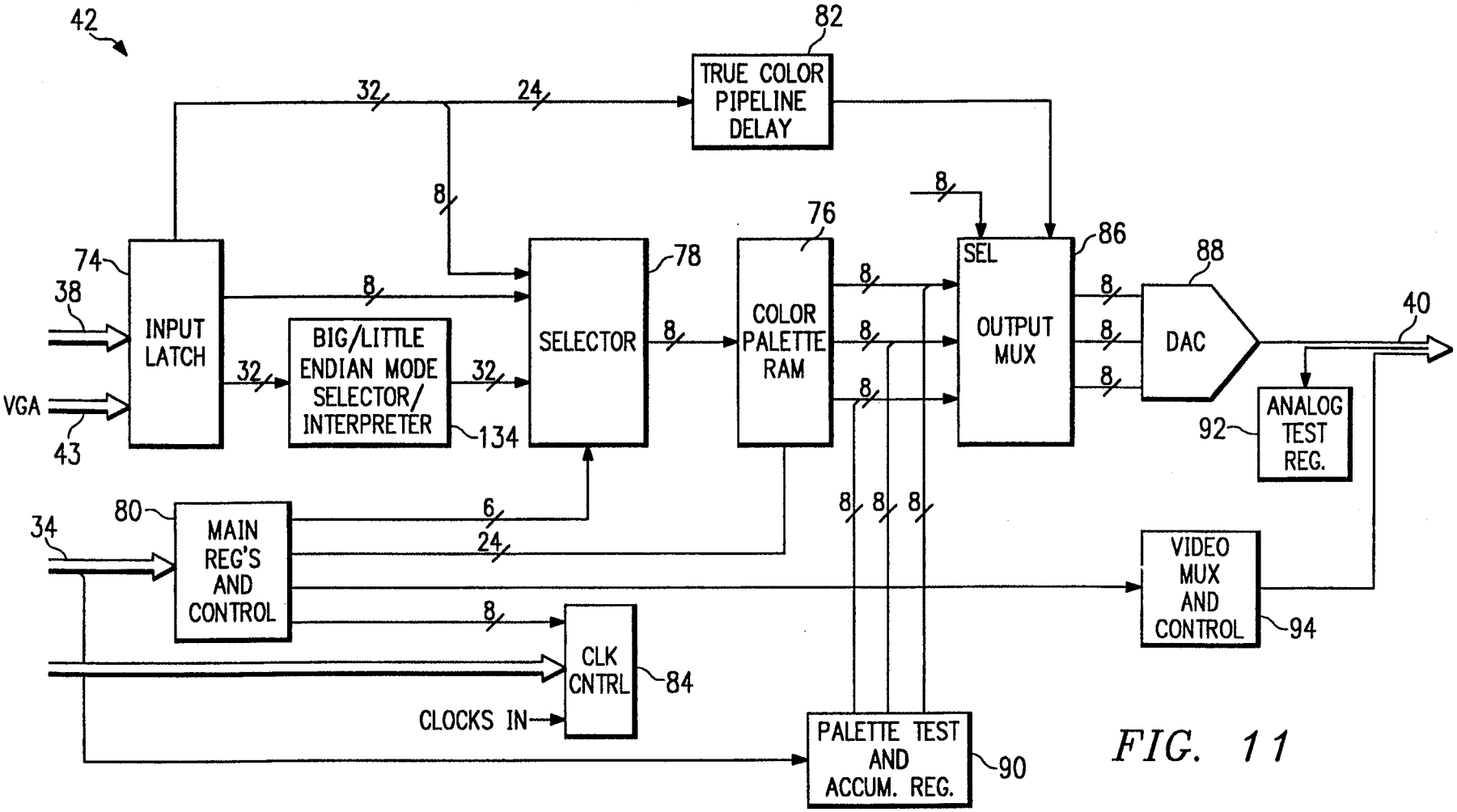
FIG. 11 is a functional block diagram of an second embodiment of color palette depicted in FIG. 1.

FIG. 11 depicts a second embodiment of color palette 42 in which big/little-endian interpretation, when required, is performed at the inputs to selector 78. In this embodiment, a 32-bit big/little-endian mode selector-/interpreter 134, constructed in accordance with the structure of FIG. 10, is provided between the input latch 74 and selector 78. Big/little-indian selector/interpreters 83 and 97 (FIGS. 4 and 5) are no longer required. In this embodiment, the recall address words forming the 32-bit color code word received from video RAM 30 may be reordered but the bits composing each individual word are not. Thus, when big/little-endian mode selector/interpreter 134 mirrors the bits comprising the 32-bit color code received from the RAM 30, it is necessary to re-order the bits within each individual recall address word when recall addresses of two or more bits per pixel are being sent to color palette RAM 76. This reordering, when required, is performed by a modified selector 78, discussed below.

Again, for this illustrated embodiment, color palette 42 is assumed to operate in the little-endian format with word reordering required when data is being transferred from video memory 30 in the big-endian format.

Figure 12:
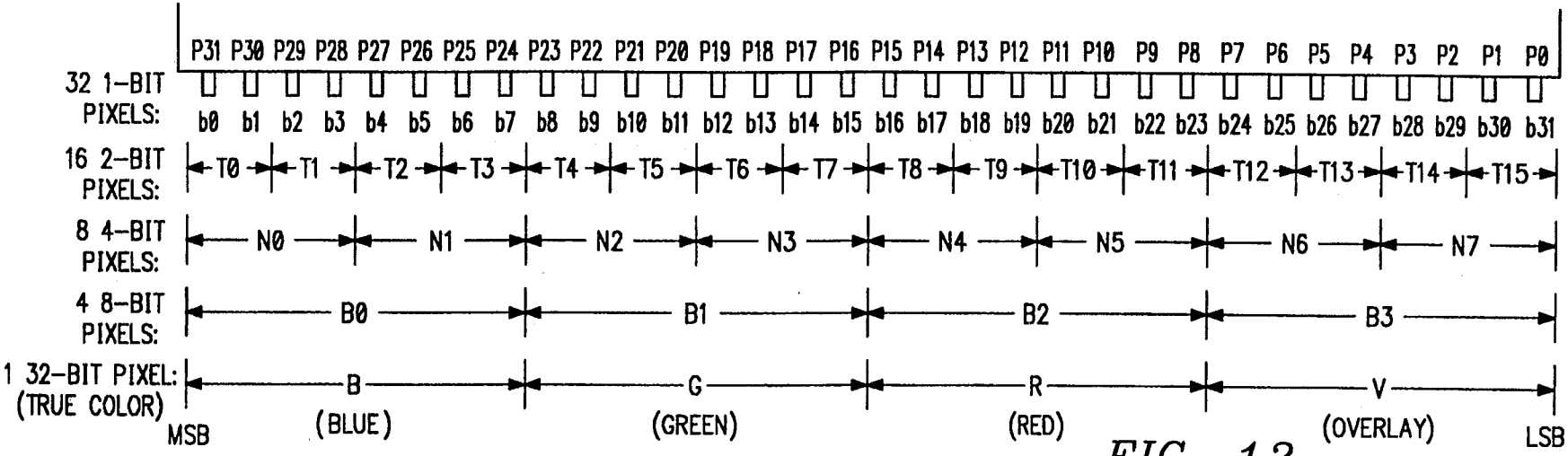
FIG. 12 is a diagram showing the mapping of data from Video RAM 30 in FIG. 1 is the big-endian word format to little-endian formatted inputs to color palette 42.
Figure 13:
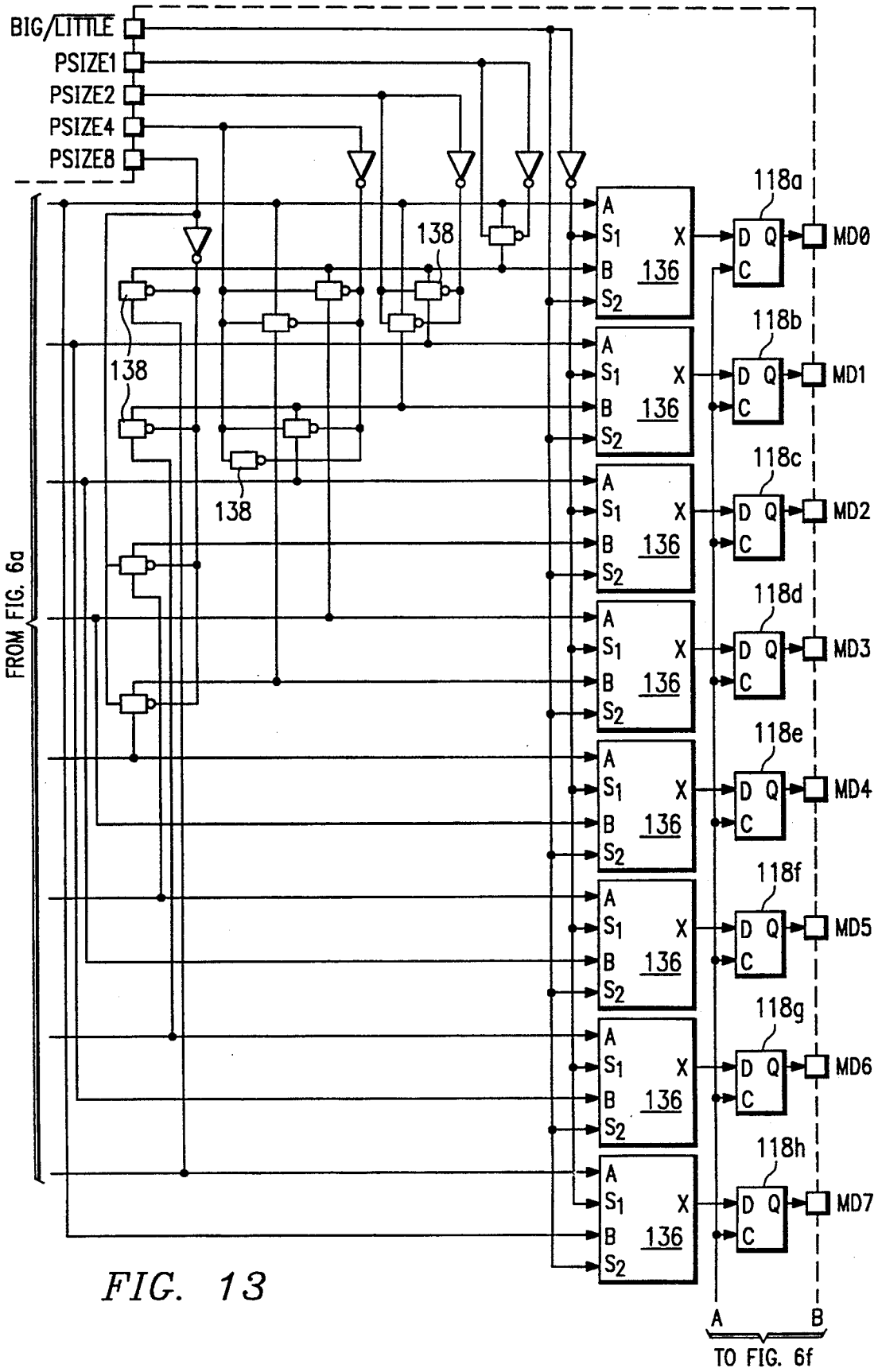
FIG. 13 is an electrical schematic diagram of a second embodiment of the selector output stages shown in FIG. 6*b.

FIG. 12 illustrates the mapping of words of data in the situation where the pin ordering of color palette 42 is in the little-endian format and words of data are being sent from frame buffer in the big-endian format. FIG. 13 depicts the modified portion of selector 78 used to reorder the bits in each individual recall address word following mirroring by big/little-endian mode selector/interpreter 134. The circuitry in FIG. 13 replaces that shown in FIG. 6*b* for the preceding embodiment. The remainder of selector 78 as shown in FIG. 6 is essentially unaltered. For simplicity, the VGA select and nibble-mode control lines (of FIG. 6*b*) have been omitted from the example.

The BIG/$\overline{\text{LITTLE}}$ control signal is set at the logic-1 level if color palette 42 is operating in the big-endian mode, and is set at the logic-0 level when color palette 42 is operating in the little-endian mode. In the little-endian mode, the 8 bits output from latches 108 (FIG. 6*a*) pass directly through the A inputs of the 8 multiplexers 136 to the D inputs of the 8 output latches 118. In the big-endian mode, the B inputs of multiplexers 136 and the paths followed by the 8 bits output from latches 108 (FIG. 6*a*) are selected as a function of the pixel size (1, 2, 4, or 8 bits) using transmission gates 138. Control signals PSIZE1, PSIZE2, PSIZE4, and PSIZE8 control which pixel size is selected according to Table.

| | PSIZE1 | PSIZE2 | PSIZE4 | PSIZE8 |
|---|---|---|---|---|
| 1 bit/pixel | 1 | 0 | 0 | 0 |
| 2 bits/pixel | 0 | 1 | 0 | 0 |
| 4 bits/pixel | 0 | 0 | 1 | 0 |
| 8 bits/pixel | 0 | 0 | 0 | 1 |

(In the little-endian mode, the PSIZE control signals are all "don't cares.")

Signals MD0-MD7 output from selector 78 are merged with the contents of an 8-bit page register (not shown). At n=1, 2, 4, or 8 bits per pixel, an 8-bit look-up table address to color palette RAM 76 is formed by concantenating the n LSBs of the 8-bit value MD0-MD7, where MDO is the LSB, with the 8-n MSBs of the page register. Thus, the 8-n MSBs of the 8-bit value at terminals MD0-MD7 are discarded.

In the big-endian mode, the bits in the 1-, 2-, 4-, or 8-bit pixel received from latches 108 (FIG. 6*a*) are in reverse order. This is the result of the 32-bit color code word containing these bits having been passed through big/little-endian mode selector/interpreter 134 (FIG. 11) before being input to selector 78. The four groups of transfer gates 138 in FIG. 13 restore the 1, 2, 4, or 8 bits of each pixel to their correct, original ordering. In the case of the 8-bit pixel (control signal PSIZE8=1), the order of the 8 bits from latches 108 (FIG. 6*a*) are mirrored before being input to the B inputs of the eight multiplexers 136. At four bits per pixel, (PSIZE4=1), the order of the topmost four of the eight bits from latches 108 (FIG. 6*a*) are mirrored before entering the B inputs of multiplexers 136. At two bits per pixel, only the top two bits are swapped before being input to the B inputs of multiplexers 136 while at one bit per pixel, only the top bit from the eight latches 108 (FIG. 6*a*) is input to the B input of the uppermost multiplexer 136.

It should be noted that in the embodiment shown in FIG. 11, that big/little-endian mode selector/interpreter 134 is located in the "critical" or "high-speed" data path where the added propagation delay may affect system performance. Thus, the circuitry of FIG. 11 is most advantageously used in systems in which the additional pipeline delay represented by big/little-endian mode selector/interpreter 134 can be tolerated.

Figure 14:
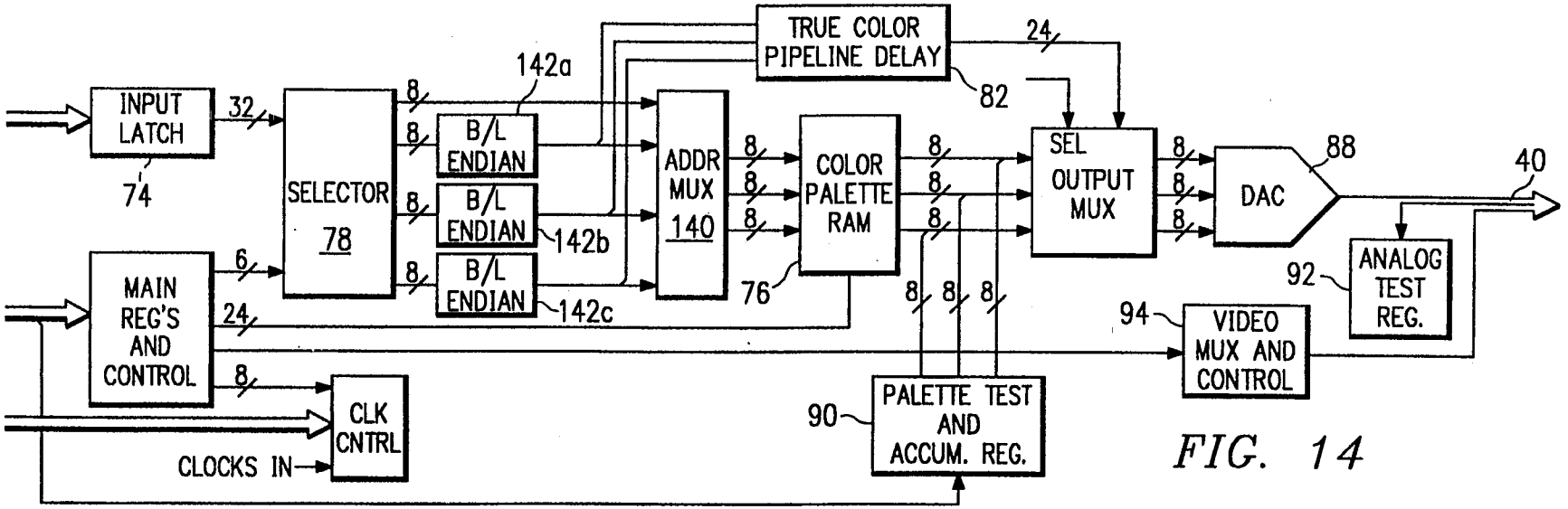
* and FIG. 14 is a functional block diagram of a third embodiment of the color palette depicted in FIG. 1.

A third embodiment of the present invention is depicted in FIG. 14. In this embodiment, the "true-color" red, green, and blue components can be used as addresses into the color look-up table (or "palette RAM" 76). This variant of the true-color operating mode, which is often referred to as the "direct color" mode, is preferably implemented by splitting the look-up table of color palette RAM 76 into three individually addressable 256-by-8-bit RAM modules. When the overlay (V) byte of a 32-bit true-color pixel is 0, the 8-bit red, green, and blue components are used to address the respective 256-by-8-bit RAM modules. If the overlay byte is a nonzero value, then the overlay (V) byte itself is used to address all three RAM modules. In a second option, the red, green and blue components of a 32-bit pixel (color code word) bypass the look-up table and are used to directly drive the three digital-to-analog converters 88.

In FIG. 14, four 8-bit data paths leave selector 78. In the direct color mode, these data paths contain the overlay, red, green, and blue components, from top to bottom, respectively. In the "pseudo-color" mode, the serialized pixel stream is transmitted along the same 8-bit data path used for the overlay components, and the lower three data paths remain unused. In other words, the operation of this portion of the circuitry in the "pseudo-color" mode is identical to that of the second embodiment discussed above. Address multiplexer block 140 contains three octal two-to-one multiplexers that in the direct color mode select between the overlay and the red, blue, and green components. Comparison circuitry determines whether the overlay component is 0 or not. If the overlay is 0, the red, green, and blue components are either used as three 8-bit addresses into the three partitions of the look-up table, or are selected by the address multiplexer 140 to drive the three digital-to-analog converters 88, according to the mode selected.

As in the second embodiment discussed above, selector 78, as depicted in FIG. 6, has been modified as shown in FIG. 13 (the circuitry of FIG. 13 replacing the circuitry of FIG. 6*b*). In the direct-color mode, the 8-bit overlay component is passed from latches 108 (FIG. 6*a*) through outputs MD0-MD7. The red, green and blue components, however, are directly output from the Q terminals of latches 108*i*- 108*af* (FIGS. 6*c*, 6*d*, and 6*e*). Three big/little-endian mode selector/interpreters 142*a*, 142*b* and 142*c*, constructed in accordance with the structure shown in FIG. 10, are coupled to the Q outputs of latches 108*i*–108*af*. The three big/little-endian mode selector/interpreters 142*a*, 142*b* and 142*c* insure that each 8-bit word of the red, green, and blue components is output in the correct order from selector 78. The circuitry of FIG. 13 insures that the overlay component is output in the correct order as required.

It is important to note that in the embodiment shown in FIG. 14, the user must connect bus 38 from video RAM 30 to the inputs to color palette 42 differently in each of the big- and little-endian systems. FIGS. 8 and 9, which describe the first embodiment, also describe the required connections for the third embodiment shown in FIG. 14. Alternately, a 32-bit selector/interpreter, constructed in accordance with FIG. 10, can be interposed between the input latch 74 and selector 78 as shown in FIG. 11. In this case, the external connections in the big- and little-endian modes are shown in FIGS. 12 and 8 respectively.

Although the present invention and its advantages have been described in detail, it should be understood that various changes, substitutions and alterations can be made herein without departing from the spirit and scope of the invention as defined by the appended claims.

What is claimed is:

1. A color palette comprising:

a plurality of first inputs for receiving multiple bits of color codes in a data format selected from the group consisting of the big-endian and little-endian data formats;

a plurality of second inputs for receiving multiple-bit color data words in said selected data format;

a plurality of third inputs for receiving multiple-bit write address words in said selected data format;

a selector coupled to said first inputs for receiving at least some of said multiple bits of color code and outputting at least one recall address in response;

a memory coupled to said selector and having a plurality of data storage locations, each said location having an associated said recall address and an associated said write address, said memory operable to output a said color data word written into a said location upon receipt of a said associated recall address from said selector;

an interpreter circuit coupled to said plurality of third inputs for selectively interpreting said selected format of a said write address received at said third inputs into an other one of said big-endian and little-endian formats; and write circuitry coupled to said interpreter circuit and said second inputs for writing a said color data word received at said second inputs to a said location in said memory associated with said write address received from said interpreter circuit.

2. The color palette of claim 1, wherein said plurality of third inputs comprise j sequentially ordered inputs and said interpreter circuit comprises:

an array of j sequentially ordered first AND gates, each said first AND gate having first and second input ports and an output port, said first input port of an $m^{th}$ one of said first AND gates coupled to an $m^{th}$ one of said third input terminals, said input ports of said first AND gates coupled to a first control signal;

an array of j sequentially ordered second AND gates, each said second AND gate having first and second input ports and an output port, said first input port of an $n^{th}$ one of said second AND gates coupled to a $(j-n+1)^{th}$ one of said third input terminals, said second input ports of said second AND gates coupled to a second control signal;

an array of j sequentially ordered OR gates each having first and second input ports and an output port, said first input of an $m^{th}$ one of said OR gates coupled to said output of said $m^{th}$ one of said first AND gates and second input port of $n^{th}$ one of said OR gates coupled to said output of said $n^{th}$ one of said second AND gates; and wherein, j is a constant, m is a variable between 1 and j, and n is a variable between 1 and j.

3. The color palette of claim 2, wherein j is a power of 2.

4. The color palette of claim 2, wherein j is equal to 8.

5. The color palette of claim 2, wherein said second control signal is the complement of said first control signal.

6. The color palette of claim 2, wherein said memory comprises a dual-port random access memory having a first address port coupled to said selector for receiving a said recall address, a second address port coupled to said write circuitry for receiving a said write address and a data port coupled to said write circuitry for receiving said color data word.

7. The color palette of claim 6, wherein said write circuitry comprises:

an address register having j inputs coupled to said outputs of said j sequentially ordered OR gates and a plurality of outputs coupled to said second address port of said memory;

a holding register having a plurality of inputs coupled to said plurality of second input ports and a plurality of outputs coupled to said data input port of said memory.

8. The color palette of claim 1 and further comprising bypass circuitry including an output multiplexer coupled to said memory and selected ones of said first inputs and operable to select for output between color data words received from said memory and selected ones of said bits of color code received at said selected ones of said first inputs.

9. The color palette of claim 8, wherein said bypass circuitry further comprises a second interpreter circuit coupled to said selected ones of said first inputs and said output multiplexer, said second interpreter circuit operable to selectively interpret said selected ones of said bits of color code received at said selected ones of said first inputs to said other one of said big-endian and little-endian data formats.

10. The color palette of claim 9, wherein said selected ones of said first inputs comprise k inputs and said second interpreter circuit comprises:

an array of k sequentially ordered first AND gates, each said first AND gate having first and second input ports and an output port, said first input port of a $p^{th}$ one of said first AND gates coupled to a $p^{th}$ one of said selected first input terminals, said second input ports of said first AND gates coupled to said first control signal;

an array of k sequentially ordered second AND gates, each said second AND gate having first and second input ports and an output port, said first input port of a $q^{th}$ one of said second AND gates coupled to a $(k-q+1)^{th}$ one of said selected first input terminals, said second input ports of said second AND gates coupled to said second control signal;

an array of k sequentially ordered OR gates each having first and second input ports and an output port, said first input of a $p^{th}$ one of said OR gates coupled to said output of said $p^{th}$ one of said first AND gates and said second input port of a $q^{th}$ one of said OR gates coupled to said output of said $q^{th}$ one of said second AND gates;

wherein k is a constant, p is a variable between 1 and k, and q is a variable between 1 and k.

11. The color palette of claim 10, wherein k is equal to 24.

12. The color palette of claim 11, wherein said plurality of first inputs comprise l inputs and wherein l is a power of 2.

13. The color palette of claim 12, wherein $l=32$ and $k=24$.

14. The color palette of claim 13, wherein said plurality of third inputs comprise r inputs and wherein r is a power of 2.

15. The color palette of claim 14, wherein r=8.

16. A color palette comprising:

a plurality of inputs for receiving multiple bits of color code and multiple bits of true-color data in a data format selected from the group consisting of the big-endian and little-endian data formats;

a selector coupled to said inputs for receiving at least some of said multiple bits of color code and outputting at least one recall address in response;

a memory coupled to said selector and having a plurality of data storage locations, each said location having an associated said recall address and an associated multiple-bit write address, said memory operable to output a color data word written into a said location upon receipt of a said associated recall address from said selector;

bypass circuitry comprising:

an interpreter circuit coupled to selected ones of said first inputs and said output multiplexer, said conversion circuit operable to selectively convert bits of true-color data received at said selected ones of said first inputs to an other one of said big-endian and little-endian data formats;

an output multiplexer coupled to said memory and said interpreter circuit and operable to select for output between said bits of color codes received at said selected ones of said inputs and true-color data output from said memory in response to a said recall address comprising bits of said multiple-bit color codes received at other ones of said inputs.

17. The color palette of claim 16, wherein said selected ones of said inputs comprise k inputs and said interpreter circuit comprises:

an array of k sequentially ordered first AND gates, each said first AND gate having first and second input ports and an output port, said first input port of a $p^{th}$ one of said first AND gates coupled to a $p^{th}$ one of said selected input terminals, said second input ports of said first AND gates coupled to said first control signal;

an array of k sequentially ordered second AND gates, each said second AND gate having first and second input ports and an output port, said first input port of a $q^{th}$ one of said second AND gates coupled to a $(k-q+1)^{th}$ one of said selected first input terminals, said second input ports of said second AND gates coupled to said second control signal;

an array of k sequentially ordered OR gates each having first and second input ports and an output port, said first input of a $p^{th}$ one of said OR gates coupled to said output of said $p^{th}$ one of said first AND gates and said second input port of a $q^{th}$ one of said OR gates coupled to said output of said $q^{th}$ one of said second AND gates;

wherein k is a constant, p is a variable between 1 and k, and q is a variable between 1 and k.

18. The color palette of claim 16 and further comprising:

a plurality of second inputs for receiving multiple-bit color data words in said selected data format;

a plurality of third inputs for receiving said multiple-bit write address words in said selected data format;

a second interpreter circuit coupled to said plurality of third inputs for selectively interpreting said selected format of a said write address word received at said third inputs into an other one of said big-endian and little-endian formats; and write circuitry coupled to said conversion circuit and said second inputs for writing a said color word received at said second inputs to a said location in said memory associated with a said write address received from said conversion circuit.

19. The color palette of claim 18, wherein said plurality of third inputs comprise j sequentially ordered inputs and said second interpreter circuit comprises:

an array of j sequentially ordered first AND gates, each said first AND gate having first and second input ports and an output port, said first input port of an $m^{th}$ one of said first AND gates coupled to an $m^{th}$ one of said third input terminals, said input ports of said first AND gates coupled to a first control signal;

an array of j sequentially ordered second AND gates, each said second AND gate having first and second input ports and an output port, said first input port of an $n^{th}$ one of said second AND gates couples to a $(j-n+1^{th})$ one of said input terminals, said second input ports of said second AND gates coupled to a second control signal;

an array of j sequentially ordered OR gates each having first and second input ports and an output port, said first input of an $m^{th}$ one of said OR gates coupled to said output of said $m^{th}$ one of said first AND gates and second input port of $n^{th}$ one of said OR gates coupled to said output of said $n^{th}$ one of said second AND gates; and wherein, j is a constant, m is a variable between 1 and j, and n is a variable between 1 and j.

20. A graphics processor system comprising:

a graphics processor controlling said system and operating in a data format selected from the big-endian and little-endian formats;

a video memory coupled to said processor for storing a plurality of multiple-bit color codes in said selected format and defining a video image to be displayed as a plurality of pixels;

a color palette comprising:

a plurality of first inputs coupled to said video memory for receiving said color codes from said video memory under the control of said processor;

a plurality of second inputs coupled to said processor for receiving multiple-bit color data words in said selected data format and defining colors of said pixels;

a plurality of third inputs coupled to said processor for receiving multiple-bit write address words in said selected data format;

a selector coupled to said first inputs for receiving at least some of said bits of said multiple-bits of color code and outputting at least one recall address in response;

a memory coupled to said selector and having a plurality of data storage locations, each said location having an associated said recall address and an associated write address word, said memory operable to output a said color data word written into said location upon receipt of a said associated recall address from said selector;

bypass circuitry comprising:

an interpreter circuit coupled to selected ones of said first inputs, said interpreter circuit operable to selectively interpret said bits of color codes received at said selected ones of said first inputs to an other one of said big-endian and little-endian data formats;

an output multiplexer coupled to said memory and said interpreter circuit and operable to select data for output between said bits of color codes received at said selected ones of said inputs and color data words output from said memory in response to a said recall address comprising bits of said multiple-bit color codes at other of said inputs;

a second interpreter circuit coupled to said plurality of third inputs for receiving multiple-bit write address words in said selected data format, said second interpreter circuit operable to selectively interpret said write address words received a said third inputs to an other one of said big-endian and little-endian data formats;

write circuitry coupled to said memory, said second interpreter circuit and said second inputs for writing a color data word received at said second inputs to a said location in said memory associated with said write address word received from said second interpreter circuit;

digital-to-analog converter circuitry coupled to said output multiplexer for converting said data selected for output into analog form; and a display coupled to said digital-to-analog converter circuitry for displaying selected images as a plurality of pixels.

21. The color palette of claim 20, wherein said plurality of third inputs comprise j sequentially ordered inputs and said second interpreter circuit comprises:

an array of j sequentially ordered first AND gates, each said first AND gate having first and second input ports and an output port, said first input port of an $m^{th}$ one of said first AND gates coupled to an $m^{th}$ one of said third input terminals, said input ports of said first AND gates coupled to a first control signal;

an array of j sequentially ordered second AND gates, each said second AND gate having first and second input ports and an output port, said first input port of an $n^{th}$ one of said second AND gates coupled to a $(j-n+1)^{th}$ one of said input terminals, said second input ports of said second AND gates coupled to a second control signal;

an array of j sequentially OR gates each having first and second input ports and an output port, said first input of an $m^{th}$ one of said OR gates coupled to said output of said $m^{th}$ one of said first AND gates and second input port of $n^{th}$ one of said OR gates coupled to said output of said $n^{th}$ one of said second AND gates, and wherein, j is a constant, m is a variable between 1 and j, and n is a variable between 1 and j.

22. A color palette comprising:

a plurality of inputs for receiving multiple bits of color codes in a data format selected from the group consisting of the big-endian and little-endian data formats;

an interpreter circuit coupled to said plurality of inputs for selectively mirroring said bits of color codes;

a selector coupled to said interpreter circuit for receiving said multiple bits of color codes and outputting at least one recall address in response, said selector further operable to selectively mirror bits comprising each said recall address; and a memory coupled to said selector and having a plurality of data storage locations, each said location having an associated said recall address, said memory operable to output a color data word written into a said location upon receipt of an associated said recall address from said selector.

23. The color palette of claim 22 wherein said selector is operable to mirror said bits comprising each said recall address following mirroring of said bits of color codes by said interpreter circuit.

24. The color palette of claim 22 wherein said selector circuit is operable to selectively mirror said bits comprising said recall address as a function of the number of said bits comprising said recall address.

25. The color palette of claim 22 wherein said plurality of inputs comprise k inputs and said interpreter circuit comprises:

an array of k sequentially ordered first AND gates, each said first AND gate having first and second input ports and an output port, said first input port of a $p^{th}$ one of said first AND gates coupled to a $p^{th}$ one of said selected input terminals, said input ports of said first AND gates coupled to said first control signals;

an array of k sequentially ordered second AND gates, each said second AND gate having first and second input ports and an output port, said first input port of a $q^{th}$ one of said second AND gates coupled to a $(k-q+1)^{th}$ one of said selected first input terminals, said second input ports of said second AND gates coupled to said second control signal;

an array of k sequentially ordered OR gates each having first and second input ports and an output port, said first input of a $p^{th}$ one of said OR gates coupled to said output of said $p^{th}$ one of said first AND gates and said second input port of a $q^{th}$ one of said OR gates coupled to said output of said $q^{th}$ one of said second AND gates;

wherein k is a constant, p is a variable between 1 and k, and q is a variable between 1 and k.

* * * * *